US009423160B2

(12) United States Patent
Xu

(10) Patent No.: US 9,423,160 B2
(45) Date of Patent: Aug. 23, 2016

(54) REGENERATIVE REFRIGERATOR

(71) Applicant: SUMITOMO HEAVY INDUSTRIES, LTD., Tokyo (JP)

(72) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 539 days.

(21) Appl. No.: 13/855,087

(22) Filed: Apr. 2, 2013

(65) Prior Publication Data

US 2013/0263607 A1 Oct. 10, 2013

(30) Foreign Application Priority Data

Apr. 4, 2012 (JP) ..... 2012-085943
Apr. 4, 2012 (JP) ..... 2012-085944

(51) Int. Cl.
*F25B 9/00* (2006.01)
*F25B 9/14* (2006.01)
*F25B 9/10* (2006.01)

(52) U.S. Cl.
CPC ... *F25B 9/14* (2013.01); *F25B 9/10* (2013.01); *F25B 9/145* (2013.01)

(58) Field of Classification Search
CPC ..... F25B 9/14; F25B 9/145; F25J 1/0022
USPC ..... 62/6, 612, 613
See application file for complete search history.

(56) References Cited

U.S. PATENT DOCUMENTS 6,915,642 B2 7/2005 Ravex
2008/0016907 A1* 1/2008 Barclay et al. ..... 62/612
2010/0139297 A1* 6/2010 McCormick et al. ..... 62/89

FOREIGN PATENT DOCUMENTS

JP 03-099162 4/1991
JP 05-066476 U 9/1993
JP H09-145180 6/1997
JP H10-009696 1/1998
JP H11-173697 7/1999
JP 2005-106297 4/2005
JP 2008-224161 9/2008
JP 2011-190954 9/2011

OTHER PUBLICATIONS

A. Ravex et al., "Free Third-Stage Cooling for Two-Stage 4 K Pulse Tube Cryocooler", Cryocoolers 14, edited by S.D. Miller and R.G. Ross, Jr. , pp. 157-161, © International Cryocooler Conference, Inc., Boulder, CO, 2007.

* cited by examiner

*Primary Examiner* — Melvin Jones
(74) *Attorney, Agent, or Firm* — IPUSA, PLLC

(57) ABSTRACT

A regenerative refrigerator includes an expander which includes a regenerator including a regenerative material and an expansion space for expanding a refrigerant gas flowing in the regenerator, the regenerator being configured such that a temperature profile at a predetermined temperature range in the regenerator is selectively higher than a case when lead is used as the regenerative material.

20 Claims, 21 Drawing Sheets

REGENERATIVE REFRIGERATOR

BACKGROUND OF THE INVENTION

1. Field of the Invention

The present invention relates to a regenerative refrigerator.

2. Description of the Related Art

A displacer type regenerative refrigerator and a pulse tube refrigerator are known. Japanese Laid-open Patent Publication No. 2008-224161 discloses a displacer type regenerative refrigerator including a displacer in which a regenerative material is provided within a tubular portion and a moving mechanism which reciprocates the displacer in a cylinder. In such a displacer type regenerative refrigerator, cooling is generated by expanding a refrigerant gas in an expansion space while reciprocating the displacer in the cylinder. Further, for the pulse tube refrigerator, cooling is generated by expanding a refrigerant gas in an expansion space while reciprocating a gas-piston in a pulse tube. The cooling of the refrigerant gas generated in the expansion space is transmitted to a cooling stage to be a desired cryogenic while being regenerated in the regenerator to refrigerate or the like an object to be cooled connected to the cooling stage.

A material having a larger specific heat capacity at a temperature inside the regenerator is used as the regenerative material. Japanese Laid-open Patent Publication No. H03-99162 discloses a structure in which a granular lead is used as a regenerative material and a granular magnetic material such as $Er_3Ni$, EuS, GdRh or the like is used as a regenerative material at a lower temperature area.

SUMMARY OF THE INVENTION

The present invention is made in light of the above problems, and provides a regenerative refrigerator capable of effectively improving refrigeration performance.

According to an embodiment, there is provided a regenerative refrigerator including an expander which includes a regenerator including a regenerative material and an expansion space for expanding a refrigerant gas flowing in the regenerator, the regenerator being configured such that a temperature profile at a predetermined temperature range in the regenerator is selectively higher than a case when lead is used as the regenerative material.

According to another embodiment, there is provided a regenerative refrigerator including an expander which includes a regenerator including a regenerative material and an expansion space for expanding a refrigerant gas flowing in the regenerator; and a temperature rising member which selectively raises a temperature profile at a predetermined temperature range in the regenerator.

According to another embodiment, there is provided a regenerative refrigerator including an expander which includes a regenerator including a first regenerative material whose specific heat capacity is smaller than that of lead within a range more than or equal to 5K and less than or equal to 20K, and a second regenerative material provided at a lower temperature side than the first regenerative material and composed of a material different from the first regenerative material, and an expansion space for expanding a refrigerant gas flowing in the regenerator, wherein the position of an interface between the first regenerative material and the second regenerative material is configured to be within a range more than or equal to 5K and less than or equal to 20K in the regenerator.

Note that also arbitrary combinations of the above-described constituents, and any exchanges of expressions in the present invention, made among methods, devices, systems and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
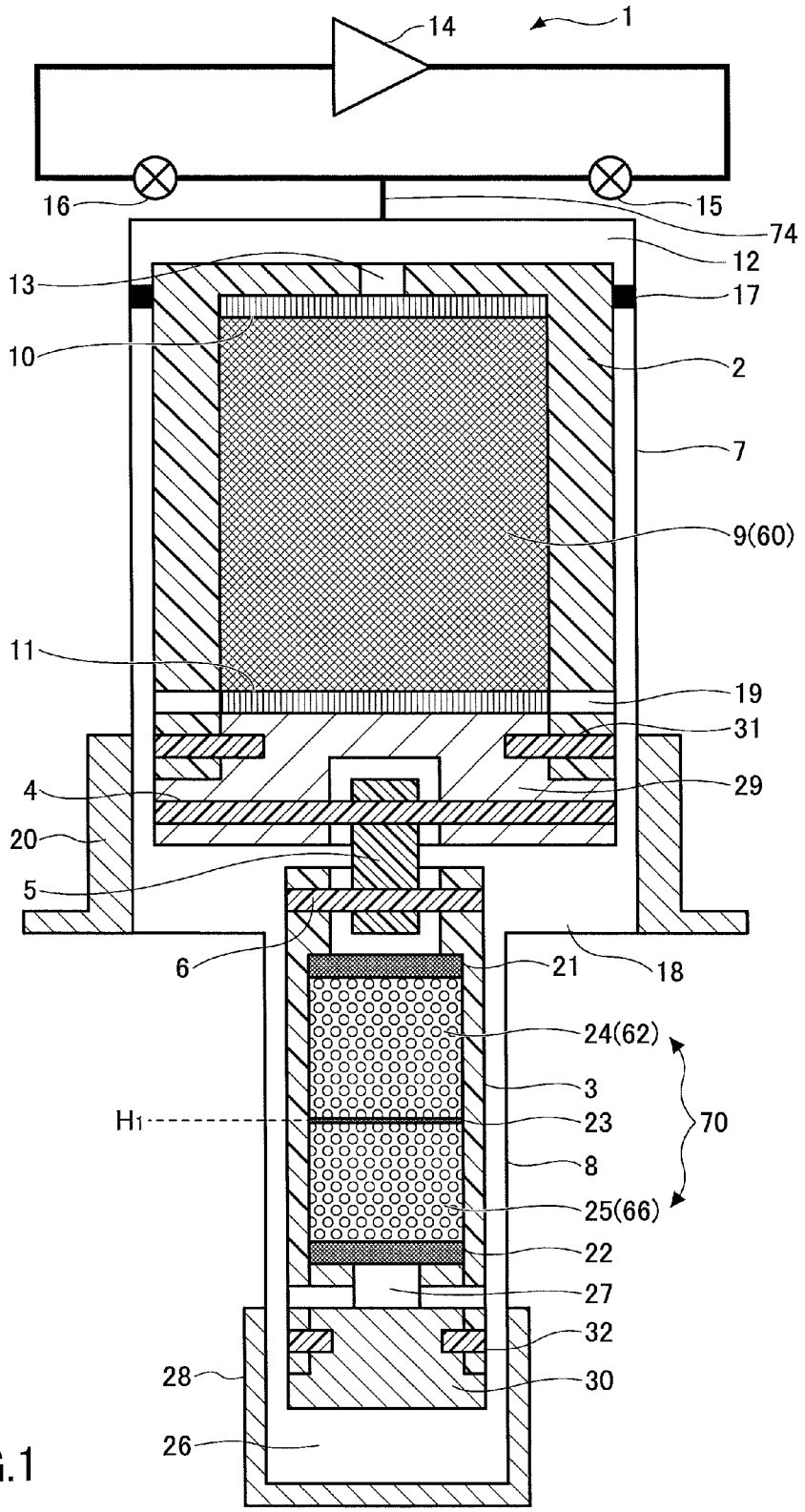
FIG. 1 is a schematic view showing an example of a structure of a regenerative refrigerator of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

In the following, a regenerative refrigerator is explained in which cooling of a desired cryogenic is generated by using Simon expansion of a high-pressure refrigerant gas supplied from a compressor and storing generated cooling by a regenerator. In the following embodiment, the regenerator may be configured such that a temperature profile within a predetermined temperature range in the regenerator becomes selectively higher compared with a case when lead is used as a regenerative material.

(First Embodiment)

In this embodiment, an example in which a regenerative refrigerator 1 is a Gifford-McMahon type refrigerator (hereinafter, simply referred to as a GM refrigerator), which is a cryogenic refrigerator, is explained.

FIG. 1 is a schematic view showing an example of a structure of the regenerative refrigerator 1 of the embodiment.

The regenerative refrigerator 1 includes a first cylinder 7 and a second cylinder 8 which are integrally formed, and a first displacer 2 and a second displacer 3 respectively provided in the first cylinder 7 and the second cylinder 8.

The first cylinder 7 houses the first displacer 2 in a reciprocatable manner in a longitudinal direction and the second cylinder 8 houses the second displacer 3 in a reciprocatable manner in a longitudinal direction. Specifically, a Scotch yoke mechanism (not shown in the drawings) is provided at a high temperature end (upper end) of the first cylinder 7 which reciprocates the first displacer 2 and the second displacer 3. The first displacer 2 and the second displacer 3 are reciprocated along the first cylinder 7 and the second cylinder 8 (expander), respectively.

The second cylinder 8 extends in the same axial direction as the first cylinder 7, and is a circular cylinder member having a diameter smaller than that of the first cylinder 7. A low temperature end (lower end) of the first cylinder 7 and a high temperature end (upper end) of the second cylinder 8 are connected at a bottom portion of the first cylinder 7.

A seal 17 is provided in the first cylinder 7 at a high temperature end (upper end) side. The first cylinder 7 is separated into a high temperature end side and a low temperature end side by the seal 17 where a room temperature chamber 12 is provided in the high temperature end side and a first expansion space 18 is provided in the low temperature end side. The volumes of the room temperature chamber 12 and the first expansion space 18 vary in accordance with the reciprocation of the first displacer 2, respectively.

A supply-discharge common pipe 74 is provided to connect a gas supply system including a compressor 14, a supply valve 15 and a return valve 16 and the room temperature chamber 12. A refrigerant gas is supplied from the supply valve 15. In this embodiment, high-pressure helium gas may be used as the refrigerant gas.

The first displacer 2 has a circular cylinder shaped outer peripheral surface. The first displacer 2 is filled with a high temperature side regenerative material 60. The high temperature side regenerative material 60 may be configured by metal gauze or the like of copper, stainless, aluminum or the like. The inner space of the first displacer 2 functions as a first regenerator 9. A gas flow regulator 10 and a gas flow regulator 11 are provided at an upper portion and a lower portion of the first regenerator 9, respectively. The first displacer 2 is provided with a first opening 13 at the high temperature end (upper end) for passing the refrigerant gas from the room temperature chamber 12 to the first displacer 2.

The first displacer 2 is further provided with a second opening 19 at the low temperature end (lower end) for passing the refrigerant gas to the first expansion space 18 via a first clearance. A first cooling stage 20 is provided at a position corresponding to the first expansion space 18 around the first cylinder 7. The first cooling stage 20 is cooled by the refrigerant gas passing through the first clearance. The first cooling stage 20 may be connected to an object to be cooled, not shown in the drawings, in a heat-exchangeable manner.

The second displacer 3 has a circular cylinder shaped outer peripheral surface. The second displacer 3 is connected to the first displacer 2 in the longitudinal direction. The first displacer 2 and the second displacer 3 are connected with each other via a pin 4, a connector 5 and a pin 6, for example.

An inner space of the second displacer 3 functions as a second regenerator 70. The first expansion space 18 and the high temperature end of the second displacer 3 are connected via a connecting path around the connector 5. The refrigerant gas passes from the first expansion space 18 to the second regenerator 70 via the connecting path. A gas flow regulator 21 and a gas flow regulator 22 are provided at an upper portion and a lower portion of the second regenerator 70, respectively.

In this embodiment, a separation plate 23 is provided inside the second displacer 3 to separate the second regenerator 70 into two stages in the axial direction. Within the inner space of the second displacer 3, a high temperature side area 24 which is at a high temperature side (upper stage) above the separation plate 23 is filled with a first regenerative material 62. The first regenerative material 62 may be in a granular form, which will be explained later in detail. A lower temperature side area 25 which is at a lower temperature side (lower stage) below the lower separation plate 23 is filled with a second regenerative material 66, which is different from the first regenerative material 62 filled in the high temperature side area 24. The second regenerative material 66 may be, for example, a granular magnetic (diamagnetic) material such as $HoCu_2$ or the like, for example. The separation plate 23 may be configured to be capable of passing the refrigerant gas but preventing passing of the granular first regenerative material 62 and the granular second regenerative material 66, respectively, for example. The separation plate 23 can prevent mixing of the first regenerative material 62 in the high temperature side area 24 and the second regenerative material 66 in the lower temperature side area 25.

A third opening 27 is provided at a low temperature end (lower end) of the second displacer 3 for passing the refrigerant gas to the second expansion space 26 via a second clearance. The second expansion space 26 is a space formed by the second cylinder 8 and the second displacer 3 and whose volume changes in accordance with the reciprocation of the second displacer 3. The second clearance is formed by a low temperature end portion of the second cylinder 8 and the second displacer 3.

A second cooling stage 28 is provided at a position corresponding to the second expansion space 26 around the second cylinder 8. The second cooling stage 28 is cooled by the refrigerant gas passing through the second clearance. The second cooling stage 28 may be connected to an object to be cooled, not shown in the drawings, in a heat-exchangeable manner.

The first displacer 2 and the second displacer 3 may include a heat exchange unit 29 and a heat exchange unit 30 at the low temperature ends, respectively. The heat exchange unit 29 and the heat exchange unit 30 have a two process circular cylinder shape in view of connection with the displacer body, respectively. The heat exchange unit 29 is fixed to the first displacer 2 by a press-in pin 31 and the heat exchange unit 30 is fixed to the second displacer 3 by a press-in pin 32. With this, the cooling efficiency can be increased by increasing an actual heat-exchanging area in the first cooling stage 20 and the second cooling stage 28, respectively.

Considering strength, thermal conductivity, shielding ability of helium or the like, the first cylinder 7 and the second cylinder 8 are respectively composed of stainless steel, for example. Considering specific gravity, strength, thermal conductivity or the like, the first displacer 2 is composed of phenol with cloth or the like, for example. The second displacer 3 is made of stainless steel, for example. A coat layer made of resin having abrasion resistance such as fluororesin or the like may be formed on an outer peripheral surface of a metal, such as stainless steel or the like, cylinder, such as the second displacer 3. Further, the granular first regenerative material 62 may be sandwiched by felt and metal gauze in the axial direction in the second displacer 3. The inner space of the second displacer 3 may be further divided into plural areas by separation plates.

The operation of the regenerative refrigerator 1 is explained.

At time in a refrigerant gas supplying process, the first displacer 2 and the second displacer 3 are positioned at the bottom dead centers of the first cylinder 7 and the second cylinder 8, respectively. When the supply valve 15 is opened at the same time or at a slightly shifted timing, high-pressure helium gas, which is the refrigerant gas, is supplied into the first cylinder 7 from the supply-discharge common pipe 74 via the supply valve 15. The refrigerant gas is introduced from the first opening 13 which is positioned above the first displacer 2 to the first regenerator 9 inside the first displacer 2.

The refrigerant gas introduced into the first regenerator 9 is supplied to the first expansion space 18 via the second opening 19 and the first clearance positioned below the first displacer 2 while being cooled by the high temperature side regenerative material 60.

The refrigerant gas supplied to the first expansion space 18 is introduced into the second regenerator 70 inside the second displacer 3 via the connecting path around the connector 5. The refrigerant gas introduced into the second regenerator 70 is supplied to the second expansion space 26 via the third opening 27 and the second clearance positioned below the second displacer 3 while being cooled by the first regenerative material 62 and the second regenerative material 66.

As such, the first expansion space 18 and the second expansion space 26 are filled with the high-pressure helium gas, which is the refrigerant gas, and the supply valve 15 is closed. At this time, the first displacer 2 and the second displacer 3 are positioned at top dead centers in the first cylinder 7 and the second cylinder 8, respectively. When the return valve 16 is opened at the same time or at a slightly shifted timing, the refrigerant gas in the first expansion space 18 and the second expansion space 26 expands. The refrigerant gas in the first expansion space 18 absorbs heat from the first cooling stage 20 via the first clearance. The refrigerant gas in the second expansion space 26 absorbs heat from the second cooling stage 28 via the second clearance.

The first displacer 2 and the second displacer 3 are moved toward the bottom dead centers again so that the volumes of the first expansion space 18 and the second expansion space 26 are reduced, respectively. The refrigerant gas in the second expansion space 26 is returned to the first expansion space 18 via the second clearance, the third opening 27, the second regenerator 70 and the connecting path. Further, the refrigerant gas in the first expansion space 18 is returned to a suction side of the compressor 14 via the second opening 19, the first regenerator 9 and the first opening 13. Meanwhile, the high temperature side regenerative material 60, the first regenerative material 62 and the second regenerative material 66 are cooled by the refrigerant gas. These processes are assumed as one cycle, and repeating the cycles, the regenerative refrigerator 1 cools the first cooling stage 20 and the second cooling stage 28.

Next, the first regenerative material 62 of the embodiment is explained.

During a normal operation of the regenerative refrigerator 1, a temperature gradient in which the temperature becomes lower from the upper side to the lower side along the axial direction of the first cylinder 7 and the second cylinder 8, respectively, is generated in the first regenerator 9 and the second regenerator 70, respectively. Hereinafter, a direction in which the temperature gradient is generated is simply referred to as an "axial direction".

For example, the temperature at a high temperature end side of the second regenerator 70 is about 40K, and the temperature at a low temperature end side of the second regenerator 70 is about 4K. On the other hand, the peak of the specific heat capacity of helium used as the refrigerant gas is about 10K. Further, the peak of the difference in density between high and lower pressures of helium is about 10K, which is almost similar to that of the specific heat capacity of helium. It means that the peaks of the specific heat capacity and the difference in density between high and lower pressures of helium exits at an intermediate temperature range of the temperature profile in the second regenerator 70.

Based on such a finding, the present inventor has found that a cooling effect of the regenerative refrigerator 1 can be increased by increasing the temperature profile in the second regenerator 70 at a temperature range in which the specific heat capacity and the difference in density between high and lower pressures of the refrigerant gas become relatively high. By increasing the temperature profile in the second regenerator 70 at such a temperature range, the existing amount of the refrigerant gas at the temperature range can be decreased. Thus, the amount of the refrigerant gas introduced into the second expansion space 26 can be increased and as a result, the cooling effect can be increased.

Thus, in this embodiment, the kind and the placement of the first regenerative material 62 are configured such that the temperature profile in the second regenerator 70 becomes high. Specifically, a regenerative material having a specific heat capacity smaller than that of lead at a range more than or equal to 5K and less than or equal to 20K is used as the first regenerative material 62 in the second regenerator 70.

On the other hand, when the regenerative material having a smaller specific heat capacity is used as the first regenerative material 62, there is a possibility that regenerating effect in the second regenerator 70 is lowered. Thus, a material capable of retaining a certain specific heat capacity as well as having a specific heat capacity smaller than that of lead at a range more than or equal to 5K and less than or equal to 20K may be used as the first regenerative material 62. As such a first regenerative material 62, a non-magnetic material such as granular bismuth, tin, silver or antimony or the like may be used. The first regenerative material 62 may be in a granular form.

Further, in this embodiment, the temperature profile at the intermediate temperature range of the temperature profile in the second regenerator 70 (a predetermined temperature range), in which the specific heat capacity and the difference in density between high and lower pressures of the refrigerant gas becomes relatively high (including the temperature range of the peak), is selectively increased. At the same time, the temperature profile at the temperature ranges of the high temperature end and the low temperature end can be retained similar as the general regenerator so that the regenerating effect in the second regenerator 70 can be maintained. Specifically, in this embodiment, it is configured that an interface ($H_1$ in the drawings) between the first regenerative material 62 and the second regenerative material 66 is positioned within a range more than or equal to 5K and less than or equal to 20K, more preferably, within a range more than or equal to 5K and less than and equal to 8K. The interface between the first regenerative material 62 and the second regenerative material 66 may be defined by the position of the separation plate 23. Here, the temperature defined in this application is a theoretical temperature calculated based on the design of the regenerative refrigerator 1.

Figure 2:
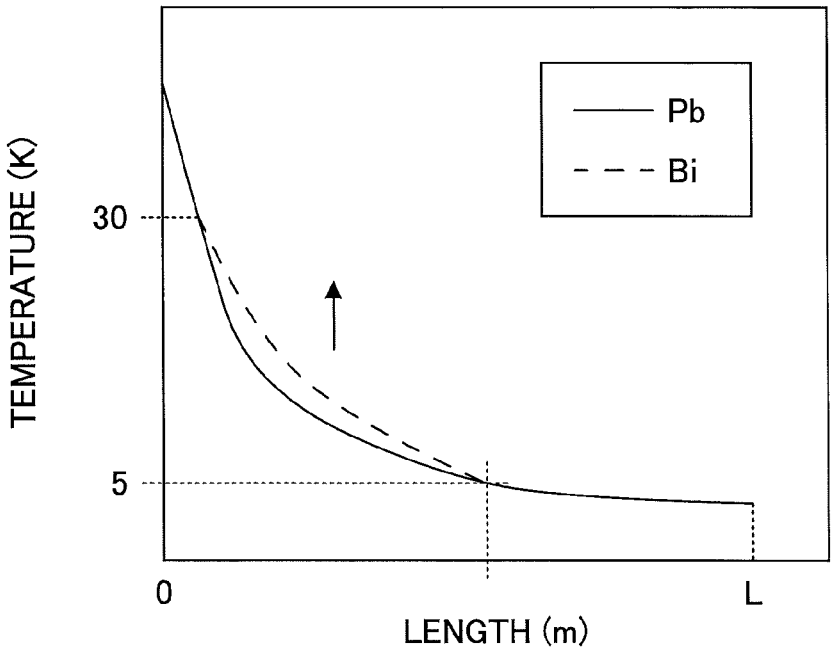
FIG. 2 is a view showing a simulation result of the first embodiment.

FIG. 2 is a view showing a simulation result of the embodiment.

The axis of abscissa shows a distance from the high temperature end of the second regenerator 70, and the axis of ordinate shows the temperature in the second regenerator 70 at the respective distance. In FIG. 2, "L" means the low temperature end of the second regenerator 70.

A result in which granular bismuth (mean diameter of 0.3 to 0.5 mm) is used as the first regenerative material 62 and the position of the interface between the first regenerative material 62 and the second regenerative material 66 ($H_1$ in the drawings) is controlled to be within 5 to 10K (hereinafter referred to as "example") is shown by a dotted line (B1). On the other hand, a result in which granular lead (mean diameter 0.3 to 0.5 mm) is used as the first regenerative material 62 (hereinafter referred to as "relative example") is shown by a solid line (Pb). In both examples, $HoCu_2$ is used as the second regenerative material 66.

As shown by the dotted line, for the example, compared with the relative example, the temperature profile in the second regenerator 70 can be increased. Especially, the temperature profile in the second regenerator 70 can be increased compared with the relative example at the intermediate temperature range of the temperature profile in the second regenerator 70, in which the specific heat capacity and the difference in density between high and lower pressures of the refrigerant gas becomes relatively high (including the temperature range of the peak). The intermediate temperature range is 5 to 30K for the example shown in FIG. 2. Here, it is not necessary to set the temperature profile to be increased for the entire of the temperature range from 5 to 30K. The temperature profile may be set higher at the temperature range (including the temperature range of the peak) in which the specific heat capacity and the difference in density between high and lower pressures of the refrigerant gas become relatively high. For example, for the lower limitation, the temperature profile may be set to be increased at the temperature range more than or equal to 8K.

Further, the refrigeration capacities are calculated for the first regenerator 9 and the second regenerator 70 of the example and the relative example. As a result, the refrigeration capacity of the first regenerator 9 is improved as well as the refrigeration capacity of the second regenerator 70 is improved in the example compared with the relative example. As such, by using a regenerative material having a specific heat capacity lower than that of lead within a range more than or equal to 5K and less than or equal to 20K as the first regenerative material 62 and controlling the interface ($H_1$ in FIG. 1) between the first regenerative material 62 and the second regenerative material 66 to be a predetermined position, the refrigeration capacities of the first regenerator 9 and the second regenerator 70 can be improved.

Figure 3:
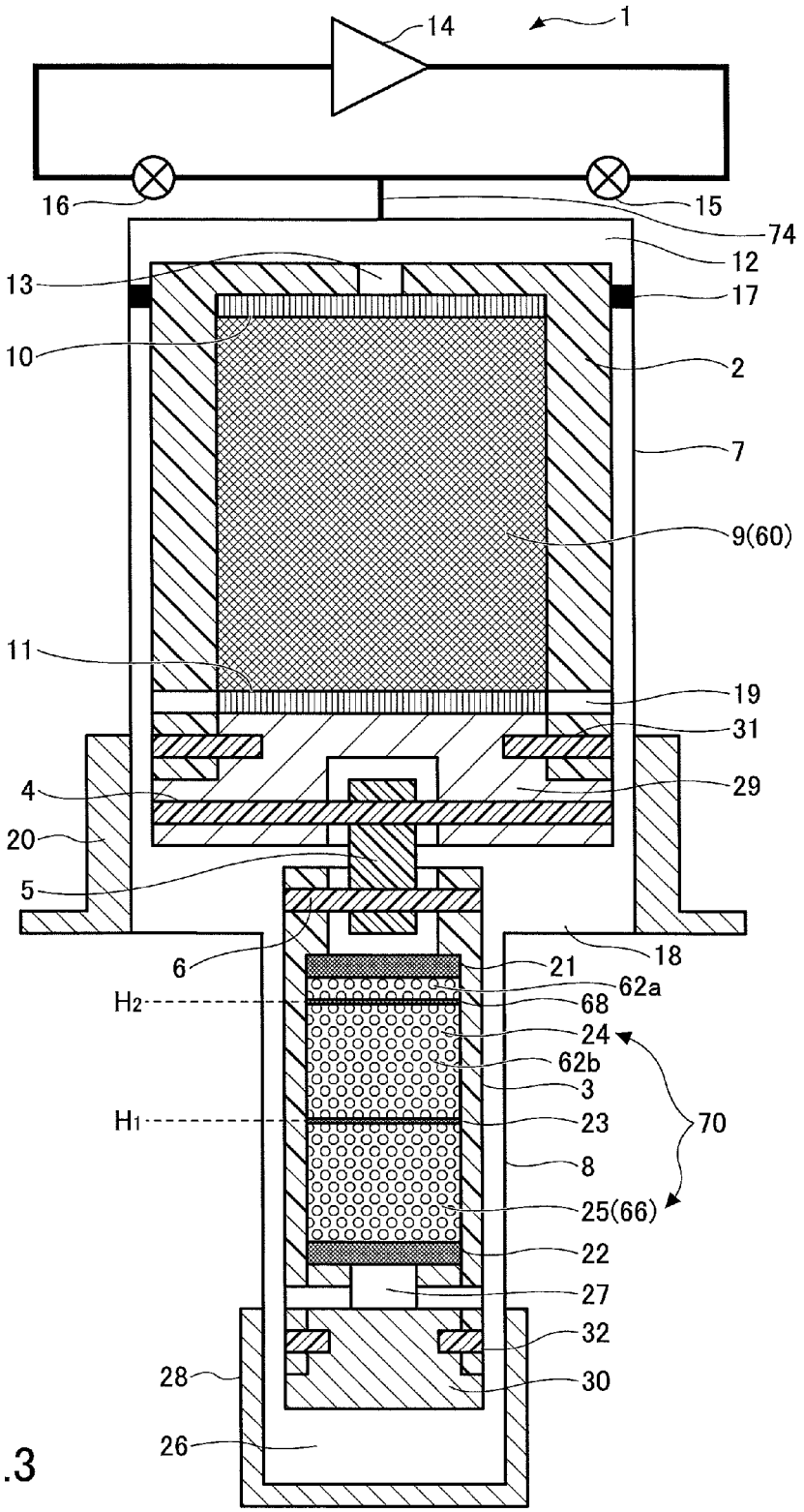
FIG. 3 is a schematic view showing another example of the regenerative refrigerator of the first embodiment.

Further the first regenerative material 62 may be composed of two or more different kinds of materials. FIG. 3 is a schematic view showing another example of the structure of the regenerative refrigerator 1 of the embodiment.

The regenerative refrigerator 1 may include a regenerative material 62*a* and a regenerative material 62*b*, as the first regenerative material 62, whose materials or compositions are different from each other. For the regenerative material 62*b*, similar to the above described first regenerative material 62, a non-magnetic material such as granular bismuth, tin, silver or antimony or the like may be used. For the regenerative material 62*a*, a material having a heat conductivity higher than that of the regenerative material 62*b* may be used, for example, or a material having a specific heat capacity higher than that of the regenerative material 62*b* at the temperature range of an area where the regenerative material 62*a* exists may be used. For example, the regenerative material 62*a* may be metal gauze or the like of copper or aluminum similar to the high temperature side regenerative material 60, a granular copper, aluminum or the like, or a non-magnetic material such as granular lead, tin or the like. Further, a mixing of lead and bismuth may be used as the regenerative material 62*a*, while bismuth may be used as the regenerative material 62*b*.

At this time, a separation plate 68 having the similar structure as the separation plate 23 may be provided inside the second displacer 3, and the second regenerator 70 may be divided into three stages by the separation plate 68 in addition to by the separation plate 23 in the axial direction. For the example explained with reference to FIG. 1, an example where only the position of the interface between the first regenerative material 62 and the second regenerative material 66 ($H_1$ in FIG. 1) is controlled. However, in this example, the position of the interface ($H_2$ in the FIG. 3) between the regenerative material 62*a* and the regenerative material 62*b* may also be controlled. The position of the interface ($H_2$ in FIG. 3) between the regenerative material 62*a* and the regenerative material 62*b* may also be determined such that the temperature profile in the second regenerator 70 at the temperature range in which the specific heat capacity and the difference in density between high and lower pressures of the refrigerant gas become relatively high (including the temperature range of the peak), is selectively increased.

(Second Embodiment)

Figure 4:
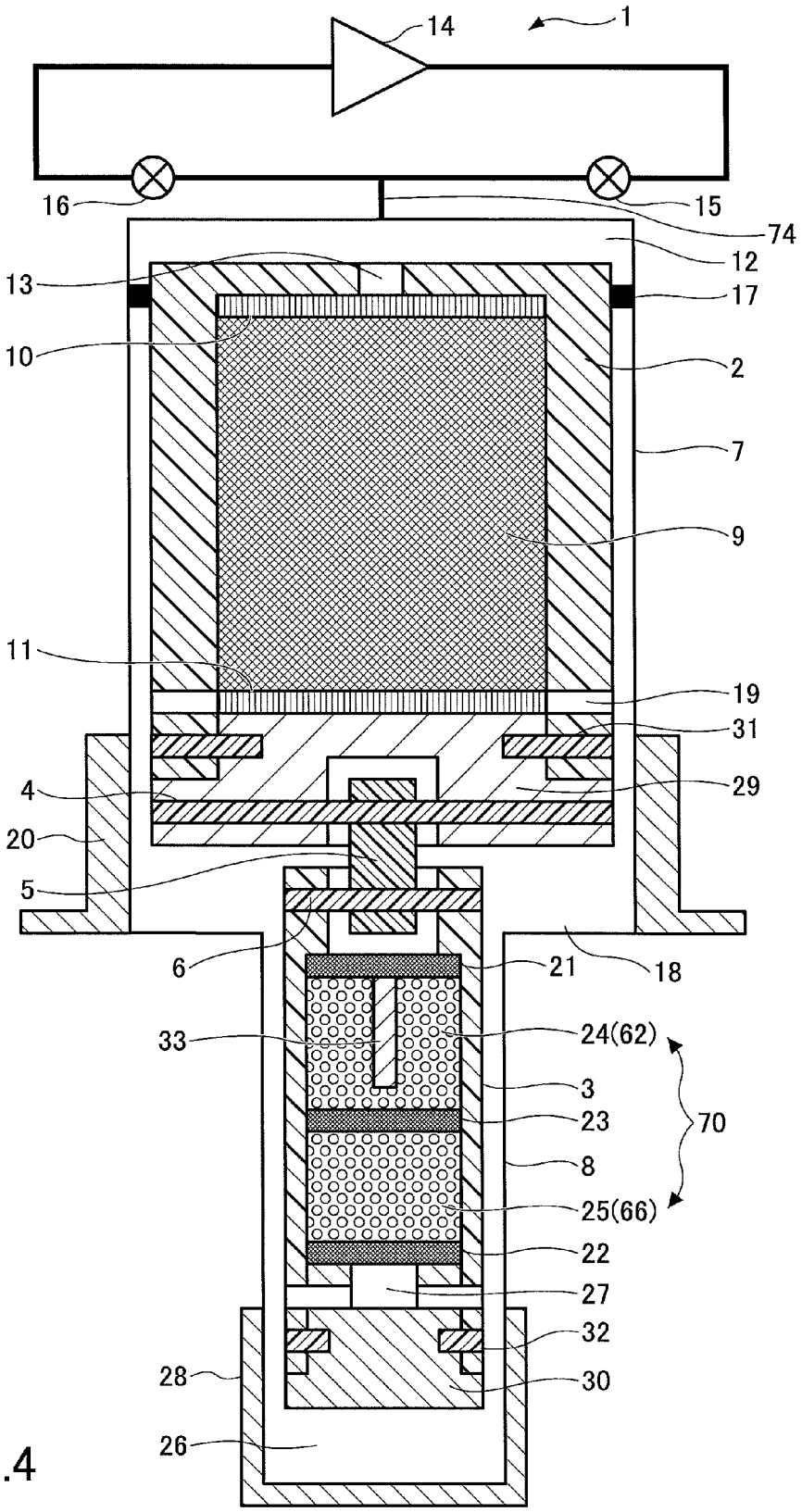
FIG. 4 is a schematic view showing an example of the regenerative refrigerator of a second embodiment.

FIG. 4 is a schematic view showing an example of a structure of the regenerative refrigerator 1 of the embodiment.

In this embodiment, the regenerative refrigerator 1 has the same structure as the regenerative refrigerator 1 explained above with reference to FIG. 1. As shown in FIG. 4, in this embodiment, the regenerative refrigerator 1 further includes a heat transfer member 33 in the high temperature side area 24 inside the second displacer 3 functioning as a temperature rising member which raises the temperature profile of the second regenerator 70.

For the first regenerative material 62, similar to the first embodiment, a non-magnetic material such as granular bismuth, tin, silver or antimony or the like may be used. Further, in this embodiment, lead may be used as the first regenerative material 62.

The heat transfer member 33 is embedded in the first regenerative material 62 to be in contact with the first regenerative material 62 and continuously extends in the axial direction. The high temperature end (upper end) of the heat transfer member 33 is positioned at a lower temperature side than the lower end of the first cooling stage 20. The low temperature end (lower end) of the heat transfer member 33 is positioned at a higher temperature side than the upper end of the second cooling stage 28. In this embodiment, heat transfer member 33 is formed to have a column shape. In this embodiment, the heat transfer member 33 is provided at a center portion of the first regenerative material 62.

For the heat transfer member 33, a material capable of transmitting heat larger than that by the second regenerator 70 in the axial direction, in other words, a material having a coefficient of thermal conductivity larger than that of the first regenerative material 62 is used. The material for the heat transfer member 33, although it depends on the material used for the first regenerative material 62, may be a material having a high thermal conductivity such as copper, aluminum, the alloy thereof or the like. Further, for the heat transfer member 33, a material having a coefficient of thermal conductivity larger than that of a material composing a sidewall (second displacer 3) of the second regenerator 70 may be used. Further, for example, when lead is used as the first regenerative material 62 or the like, for example, bismuth or an alloy of bismuth and copper, aluminum or the like may be used as the heat transfer member 33.

Further, similar to the first embodiment, according to the present embodiment, the temperature profile at the intermediate temperature range of the temperature profile in the second regenerator 70, in which the specific heat capacity and the difference in density between high and low pressures of the refrigerant gas become relatively high, is selectively increased. At the same time, the temperature profile at the temperature ranges of the high temperature end and the low temperature end can be retained similar as the general regenerator so that the regenerating effect in the second regenerator 70 can be maintained.

The position of the heat transfer member 33 in the axial direction in the high temperature side area 24 may be set to satisfy such a condition based on a temperature distribution in the high temperature side area 24 when the regenerative refrigerator 1 is being normally operated.

For example, the position of the low temperature end of the heat transfer member 33 in the axial direction may be set at an area where the specific heat capacity of the helium gas as the refrigerant gas is larger than the specific heat capacity of the first regenerative material 62. Specifically, for example, the position of the low temperature end of the heat transfer member 33 in the axial direction may be set within a range more than or equal to 8K and less than or equal to 20K, and more preferably, within a range more than or equal to 8K and less than or equal to 10 and a few more K, for example, while the regenerative refrigerator 1 is being operated. In this embodiment, the position of the low temperature end of the heat transfer member 33 in the axial direction may be 8K, for example. Further, the provided position of the heat transfer member 33 may be controlled as follows. The temperature profile in the second regenerator 70 becomes high at the temperature range in which the specific heat capacity and the difference in density between high and low pressures of the refrigerant gas become relatively high. At the same time, the temperature profile at the temperature ranges of the high temperature end and the low temperature end can be retained similar as the general regenerator so that the regenerating effect in the second regenerator 70 can be maintained.

In this embodiment, the low temperature end of the heat transfer member 33 may be at a position apart from the separation plate 23 for a predetermined distance toward the high temperature side. Further, the high temperature end of the heat transfer member 33 may be in contact with the gas flow regulator 21. Further, although not shown in FIG. 4, the heat transfer member 33 may include a support member for retaining a position of the heat transfer member 33 in the high temperature side area 24 in the axial direction. For example, a support member having a cross-shape may be provided at the low temperature end of the heat transfer member 33.

According to the regenerative refrigerator 1 and the second regenerator 70 of the embodiment, the following advantages can be obtained. The temperature profile from the high temperature end to the low temperature end in the high temperature side area 24 shows a tendency to be in inverse proportion with respect to the distance from the high temperature end as a hyperbola profile (see FIG. 2). In this embodiment, by providing the heat transfer member 33, the heat from the high temperature side of the high temperature side area 24 is efficiently transmitted to the lower temperature side via the heat transfer member 33. Thus, similar to the case explained above with reference to FIG. 2, the temperature profile in the second regenerator 70 can be shifted to the high temperature side at the intermediate temperature range, compared with a case without the heat transfer member 33. By the increasing of the temperature profile in the high temperature side area 24, the amount of the helium gas staying in the area is reduced to increase the pressure difference of the total refrigerator system. Thus, the refrigeration performance can be increased.

Further, in this embodiment, as the heat transfer member 33 extends in the axial direction of the second regenerator 70 and transmits the heat from the high temperature end to the low temperature end, the temperature of the first cooling stage 20 can be decreased to improve the refrigeration performance of the first cooling stage 20. Further, by controlling the provided position of the heat transfer member 33, the temperature profile in the vicinity of the high temperature end and the low temperature end of the second regenerator 70 can be retained as the general structure without the heat transfer member 33. Thus, the refrigeration performance of the first cooling stage 20 can be improved while maintaining the refrigeration performance of the second cooling stage 28.

Figure 5A:
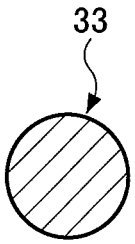
FIG. 5A to FIG. 5D are schematic views showing an example of a structure of a heat transfer member of the regenerative refrigerator.
Figure 5B:
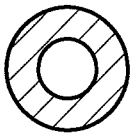
Figure 5C:
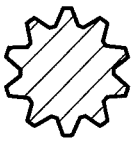
Figure 5D:
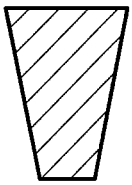

Although the heat transfer member 33 having a circular cylinder shape is exemplified in FIG. 4, the structure of the heat transfer member 33 may be arbitrarily determined in accordance with a manufacturing easiness, a way of offsetting the temperature profile, in other words, a degree of the heat exchange with the first regenerative material 62 or the refrigerant gas. It means that the shape of the heat transfer member 33 taken along a cross-section vertical to the axial direction may be a circle as shown in FIG. 5A, a cylinder as shown in FIG. 5B, a circle provided with fins at an outer peripheral surface as shown in FIG. 5C. Further the shape of the heat transfer member 33 taken along a cross-section in the axial direction may be a trapezoid shape where the high temperature end is wider as shown in FIG. 5D, for example.

Figure 6:
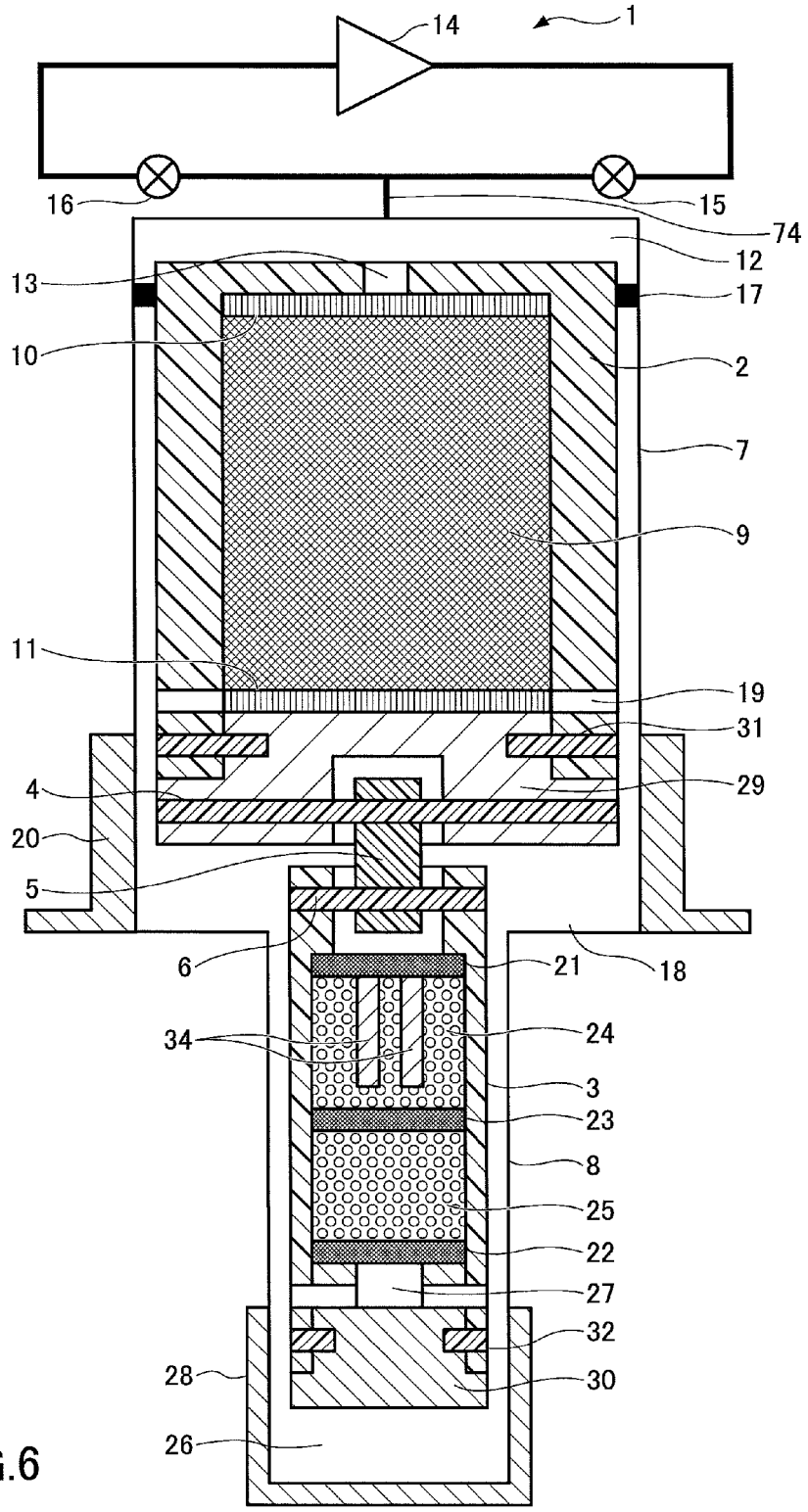
FIG. 6 is a schematic view showing another example of the regenerative refrigerator of the second embodiment.

Further, a structure in which the single heat transfer member 33 is provided at a center of the high temperature side area 24 of the second regenerator 70 is provided is shown in FIG. 4. Alternatively, as shown in FIG. 6, plural of the heat transfer members 33 may be provided to be discretely positioned and apart from the center in the radius direction. For this case, the cross sectional area of each of the heat transfer members 33 may be set to be smaller than that of the heat transfer member 33 shown in FIG. 4 considering a balance between the total heat capacity of the plural heat transfer members 34 and the volume and the heat capacity of the second regenerative material 66.

Figure 7:
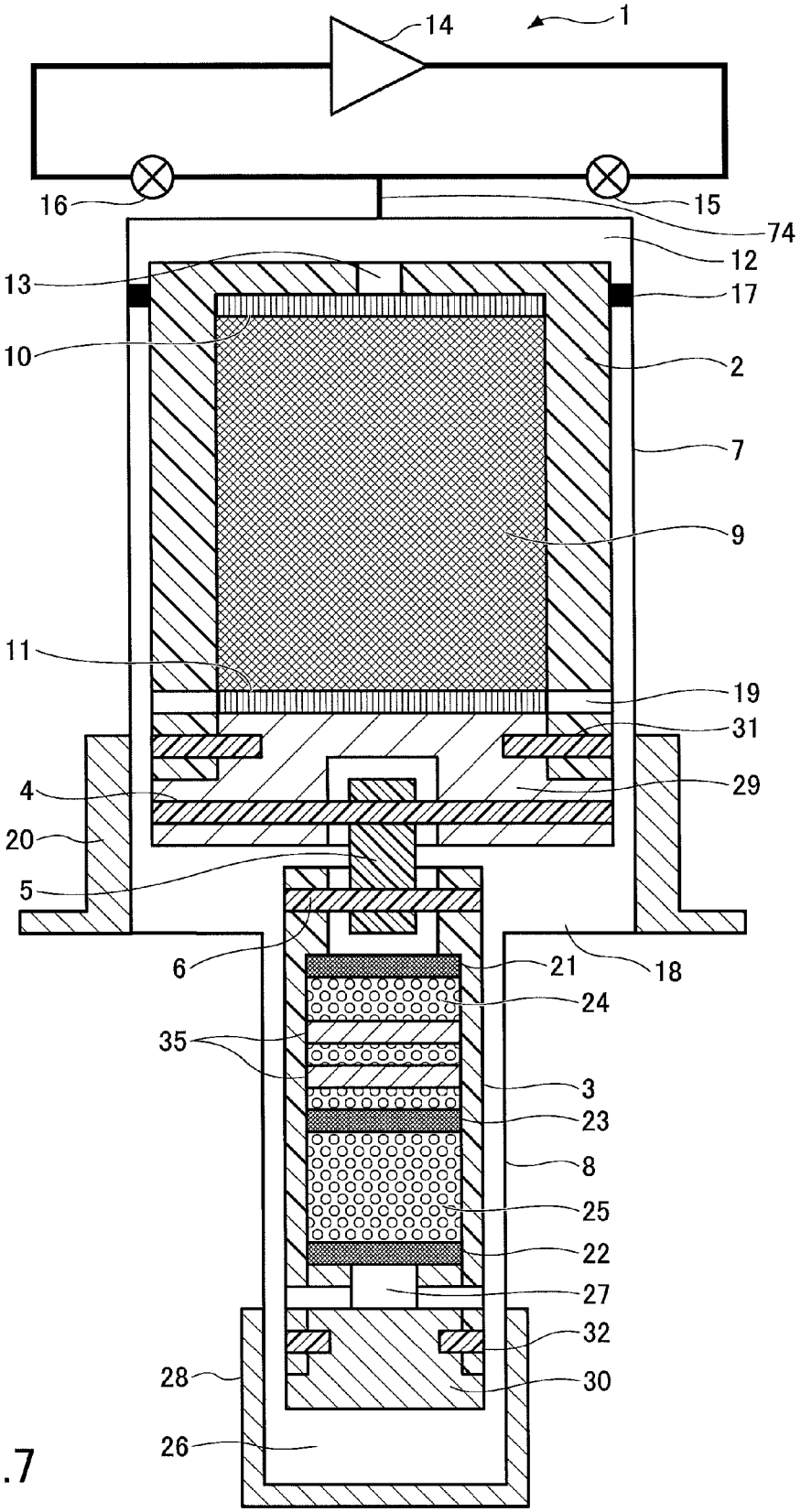
FIG. 7 is a schematic view showing another example of the regenerative refrigerator of the second embodiment.

Further, the configuration of the heat transfer member is not limited to the above described embodiment. For example, as shown in FIG. 7, the heat transfer member 35 may be formed to be plural discs discretely provided at upper and lower in the axial direction having a shape corresponding to the circular cylinder shape of the high temperature side area 24 of the second regenerator 70.

Figure 8:
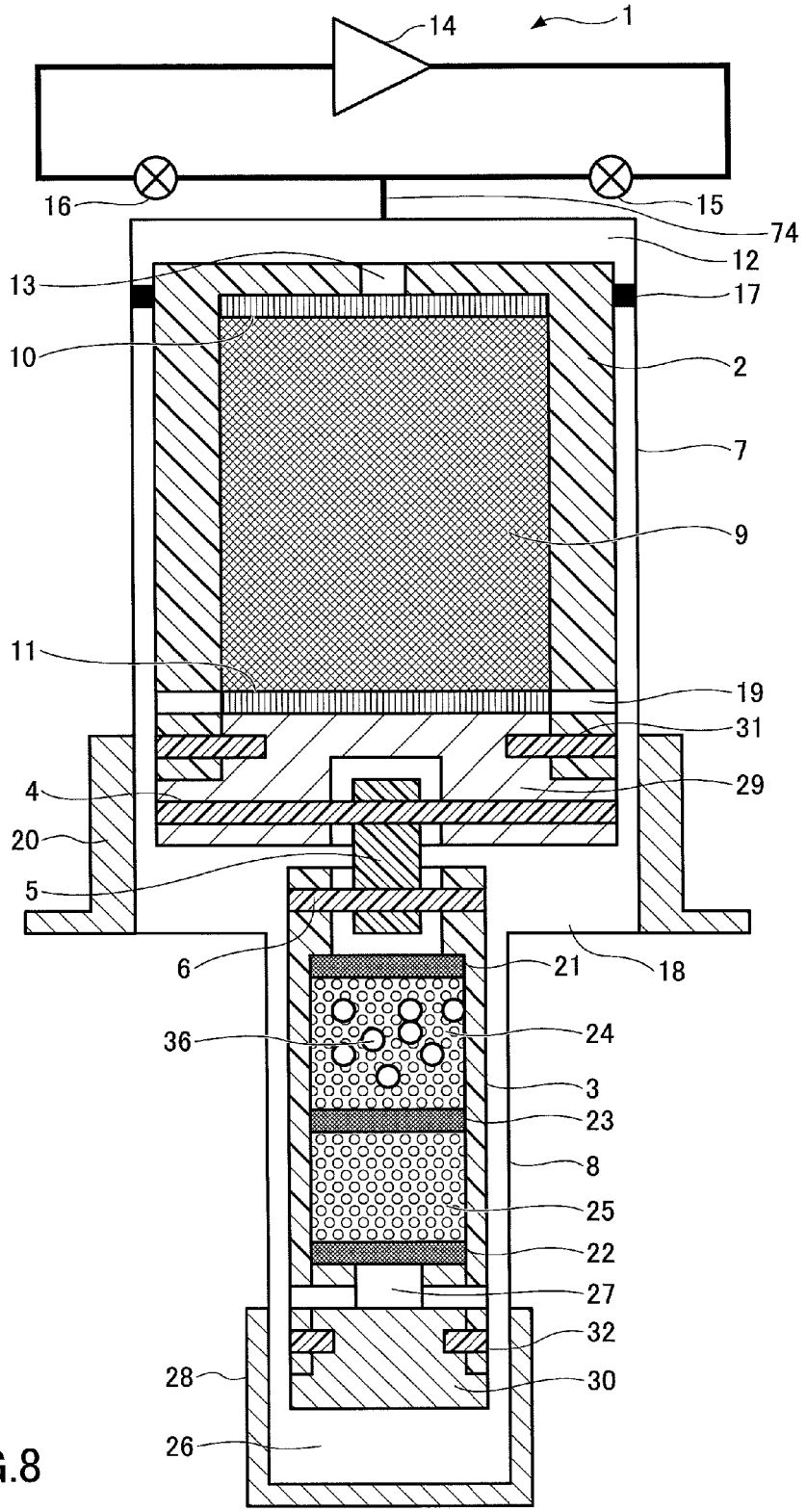
FIG. 8 is a schematic view showing another example of the regenerative refrigerator of the second embodiment.

Further, as shown in FIG. 8, the heat transfer member 36 may be formed in a granular form. Then, particles of the heat transfer member 36 may be discretely dispersed in the first regenerative material 62 in the axial direction and in the radius direction. For this case, the diameter of the particle of the heat transfer member 36 may be larger than, equal to or less than that of the first regenerative material 62. For this case, a material similar as the material composing the first regenerative material 62 (regenerative material 62*b*) in the first embodiment may be used as the heat transfer member 36. For example, in this embodiment, the first regenerative material 62 may be composed of granular lead and the heat transfer member 36 may be composed of granular bismuth, for example.

(Third Embodiment)

In the second embodiment, a structure in which the heat transfer member is provided inside the second regenerator 70 is exemplified. Alternatively, the heat transfer member may be formed to have a circular cylinder shape which surrounds the first regenerative material 62 in the second regenerator 70.

Figure 9:
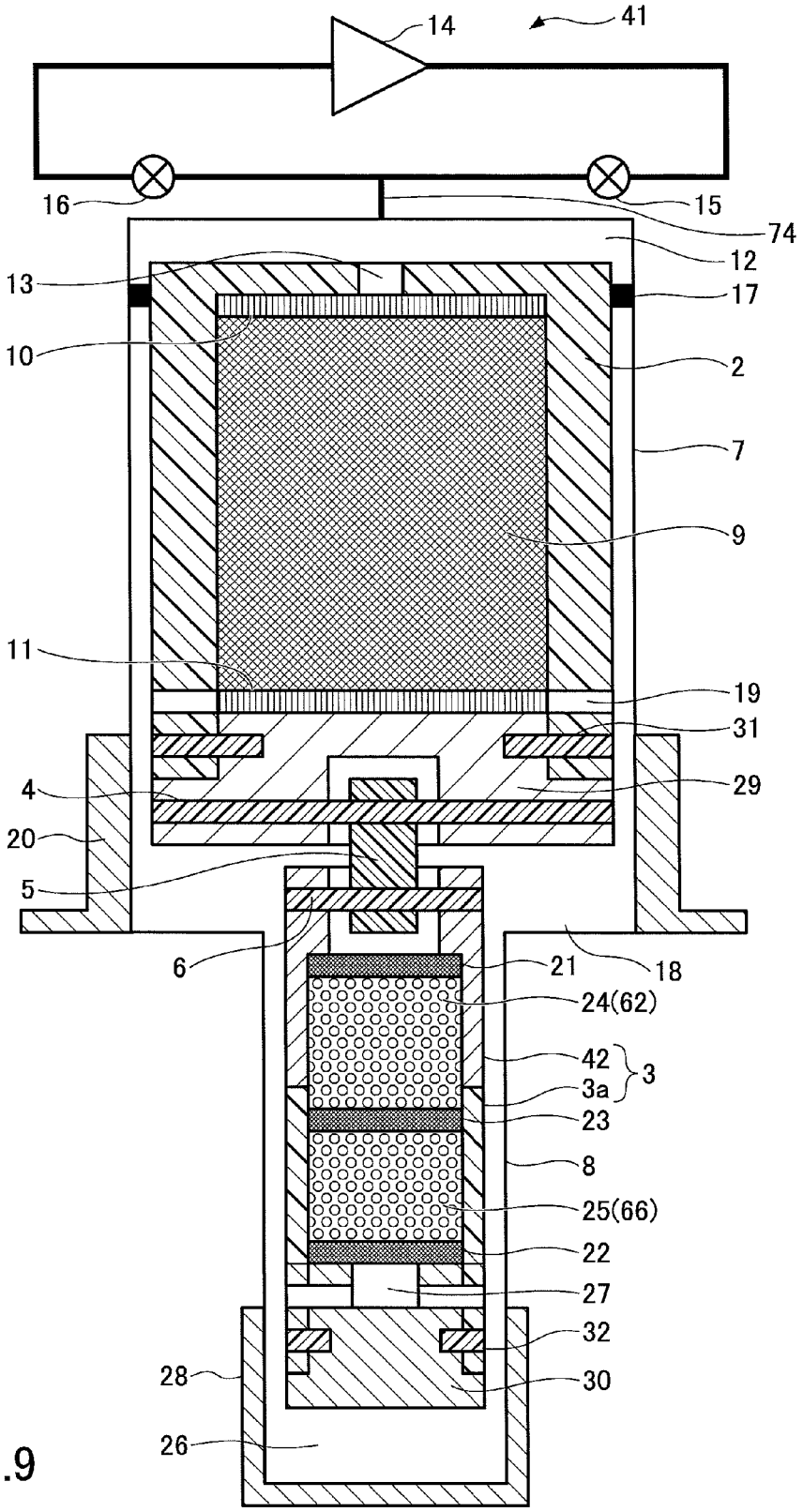
FIG. 9 is a schematic view showing an example of the regenerative refrigerator of a third embodiment.

FIG. 9 is a schematic view showing an example of a structure of a regenerative refrigerator 41 of the embodiment.

As the regenerative refrigerator 41 of the embodiment has the same function, the same operation and the basic structural components for the refrigerator as the regenerative refrigerator 1 of the first embodiment, the same components are given the same reference numerals, and explanations are not repeated.

The regenerative refrigerator 41 of the embodiment includes a circular cylinder shaped heat transfer member 42 which surrounds the first regenerative material 62 in the high temperature side area 24. It means that in this embodiment, a part of a side wall of the second displacer 3 is composed of a material which functions as the heat transfer member 42. Hereinafter, among the second displacer 3, an area which does not function as the heat transfer member 42 is referred to as a second displacer 3*a*. The outer peripheral surface shape of the heat transfer member 42 is the same as the outer peripheral surface shape of the second displacer 3*a*. The low temperature end of the heat transfer member 42 is connected to the high temperature end of the second displacer 3*a* and the second displacer 3*a* is connected to the pin 6 via the heat transfer member 42. The heat transfer member 42 may be composed of the same material as the heat transfer member 33 or the like explained in the second embodiment.

In this embodiment, the heat transfer member 42 is positioned such that the high temperature end is positioned at the higher temperature side than the lower end of the first cooling stage 20 as well as at the lower temperature side than the upper end of the first cooling stage 20 in the axial direction in the first expansion space 18.

In this embodiment as well, similar to the transfer member 33 of the second embodiment, the position of the low temperature end of the heat transfer member 42 in the axial direction may be set within a range more than or equal to 8K and less than or equal to 20K, and more preferably, within a range more than or equal to 8K and less than or equal to 10 and a few more K while the regenerative refrigerator 41 is being operated. Further, the provided position of the heat transfer member 42 may be similarly controlled as the heat transfer member 33 or the like. With this, the same advantages as the second embodiment can be obtained.

According to the structure of the embodiment, the high temperature end of the heat transfer member 42 can be positioned further higher temperature side in the axial direction. Thus, the temperature of the first cooling stage 20 can be effectively lowered.

Figure 10:
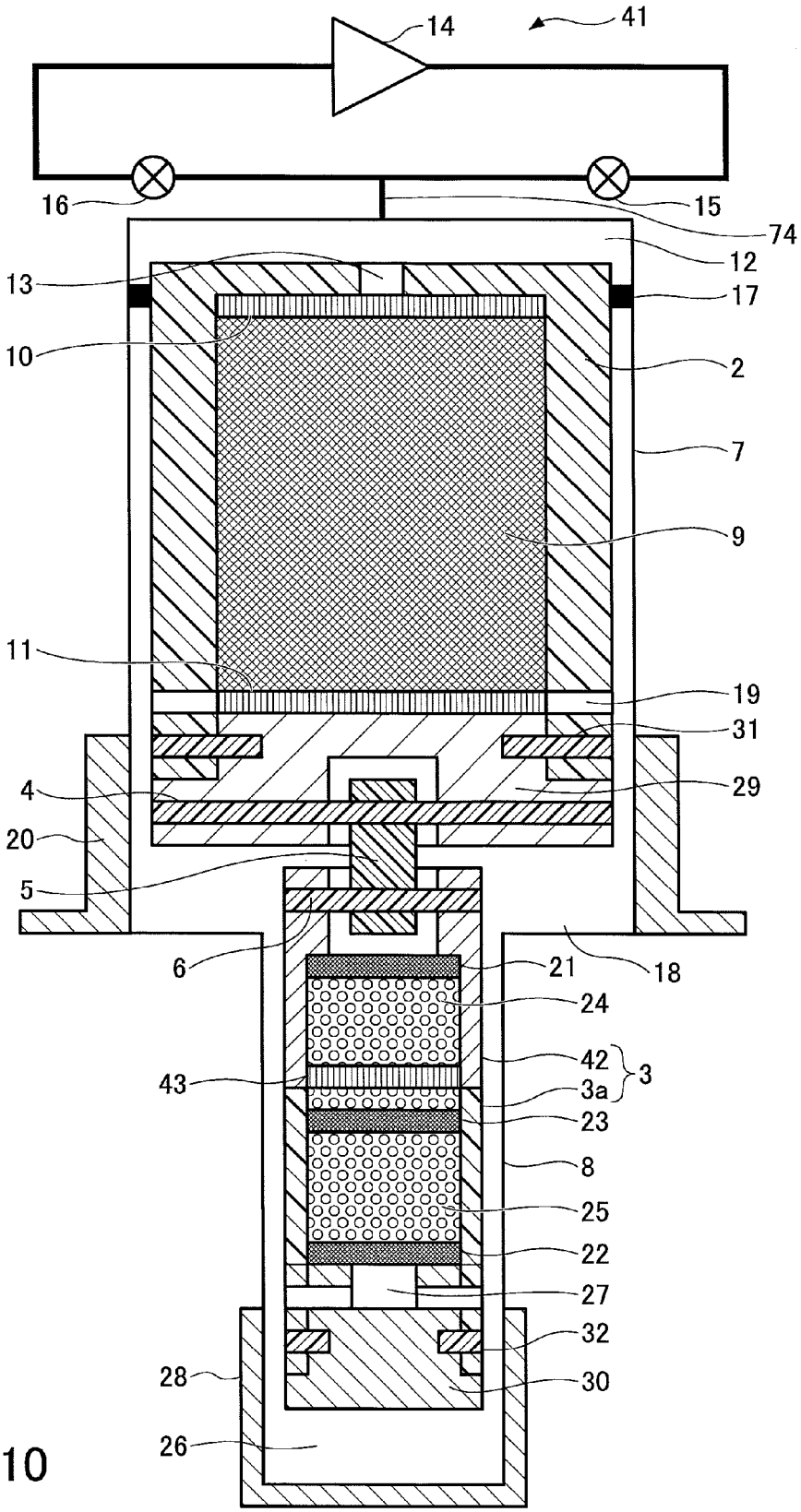
FIG. 10 is a schematic view showing another example of the regenerative refrigerator of the third embodiment.

FIG. 10 is a schematic view showing another example of the regenerative refrigerator 41 of the embodiment.

The flowing speed of the refrigerant gas passing within the high temperature side area 24 tends to be lower as being apart from the center in the radius direction. Thus, a heat exchanger 43 provided with plural through holes may be provided at an inner peripheral side of the low temperature end of the heat transfer member 42. With this, the temperature of the first cooling stage 20 can be effectively lowered so that the regenerating efficiency can be increased.

In this embodiment, a structure in which the heat transfer member 42 composes a part of the sidewall of the second displacer 3 is exemplified. Alternatively, the heat transfer member 42 may be provided inside the second displacer 3 to surround the first regenerative material 62. For this case, the heat transfer member 42 may not necessarily surround entirety of the first regenerative material 62 and may surround at least a part of the first regenerative material 62.

(Fourth Embodiment)

In the second embodiment and in the third embodiment, the regenerative refrigerator of two stages including the first regenerator 9 and the second regenerator 70 is exemplified. Alternatively, a regenerative refrigerator of a single stage may be used.

Figure 11:
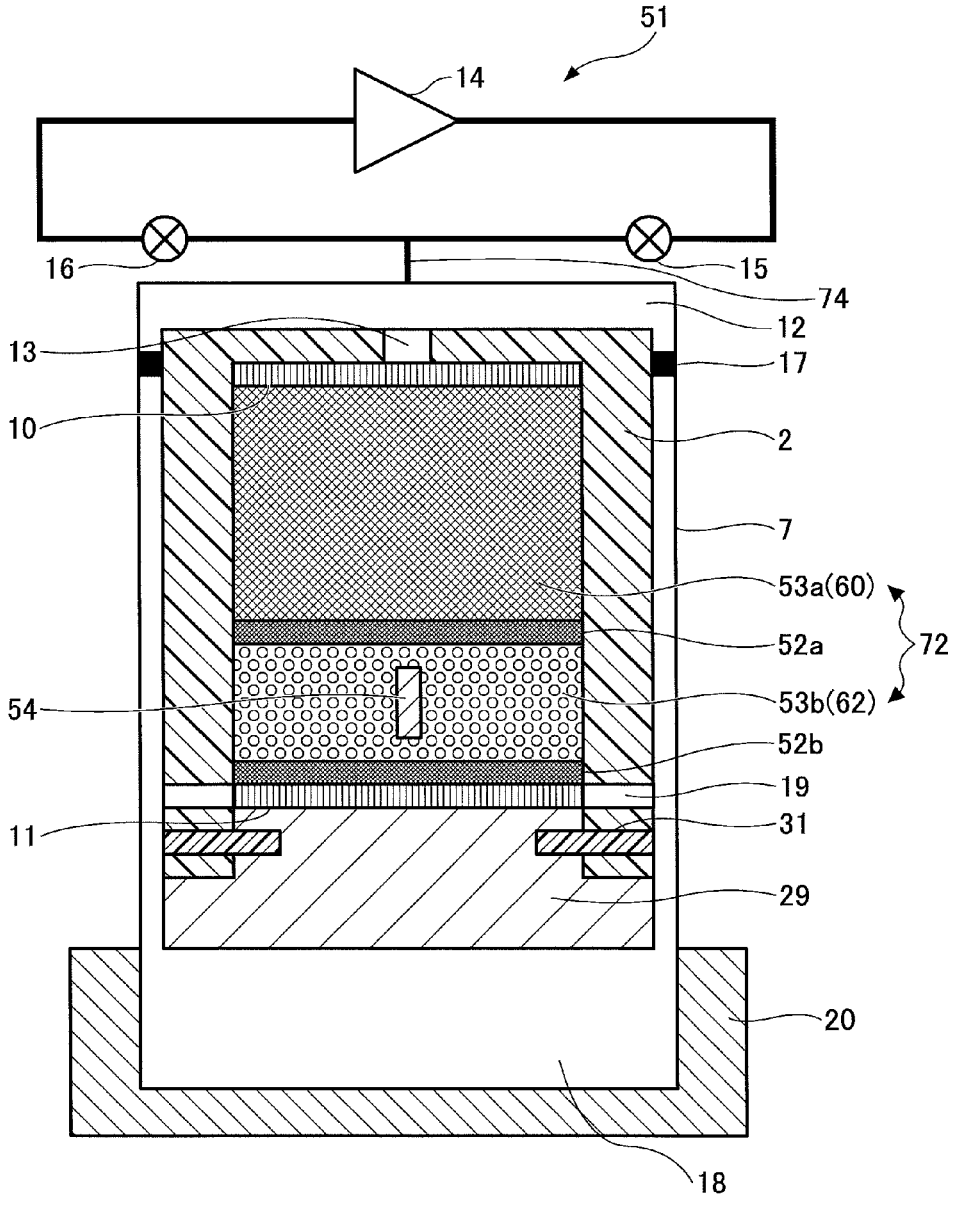
FIG. 11 is a schematic view showing an example of the regenerative refrigerator of a fourth embodiment.

FIG. 11 is a perspective view showing an example of a structure of a regenerative refrigerator 51 of the embodiment. In FIG. 11, the same components are given the same reference numerals as FIG. 4, and explanations are not repeated.

The regenerative refrigerator 51 of the embodiment is different from the regenerative refrigerator 1 or the like explained above in that only the first cylinder 7 is provided and the second cylinder 8 is not provided. In the first displacer 2, a high temperature side area 53*a* and a lower temperature side area 53*b* are provided at an upper stage and a lower stage in the axial direction, respectively. The high temperature side area 53*a* and the lower temperature side area 53*b* compose a single regenerator 72. The high temperature side area 53*a* is filled with the high temperature side regenerative material 60. The high temperature side regenerative material 60 may be metal gauze or the like of copper or aluminum. The lower temperature side area 53*b* is filled with the first regenerative material 62 which is different from the high temperature side regenerative material 60. For the first regenerative material 62, for example, a non-magnetic material such as granular lead, bismuth, tin, silver or antimony or the like may be used. The first regenerative material 62 may be formed in a granular form.

A separation plate 52*a* which separates the high temperature side regenerative material 60 and the first regenerative material 62 is provided in the first displacer 2, and the high temperature side area 53*a* and the lower temperature side area 53*b* are formed by the separation plate 52*a*. Further, in this embodiment, a separation plate 52*b* is provided at the low temperature end of the lower temperature side area 53*b*.

In this embodiment, the regenerative refrigerator 51 further includes a heat transfer member 54 functioning as a temperature rising member which raises the temperature profile of the second regenerator 72. The heat transfer member 54 may be composed of the similar material as the heat transfer member 33 or the like explained above in the second embodiment. The heat transfer member 54 is formed to have a column shape. The heat transfer member 54 is embedded in the first regenerative material 62 at the center to be in contact with the regenerative material 62 and continuously extends in the axial direction. In this embodiment, the high temperature end of the heat transfer member 54 is apart from the upper side separation plate 52*a* while the low temperature end of the heat transfer member 54 is also apart from the lower side separation plate 52*b*. In this embodiment as well, similar to the heat transfer member 33 or the like of the second embodiment, the position of the low temperature end of the heat transfer member 54 in the axial direction may be set within a range more than or equal to 8K and less than or equal to 20K, and more preferably, within a range more than or equal to 8K and less than or equal to 10 and a few more K, for example, while the regenerative refrigerator 51 is being operated. Further, the provided position of the heat transfer member 54 may be similarly controlled as the heat transfer member 33 or the like. With this, the same advantages as the second embodiment can be obtained.

In this embodiment, the heat is transmitted from the high temperature end to the low temperature end of the heat transfer member 54, and the temperature profile in the vicinity of the low temperature end of the heat transfer member 54 can be selectively increased as well as the first regenerative material 62 inside the lower temperature side area 53 which is positioned at the higher temperature side than the heat transfer member 54 is cooled so that the refrigeration capacity of the entirety of the regenerative refrigerator 51 can be improved. Further, by controlling the provided position of the heat transfer member 54, the temperature profile in the vicinity of the high temperature end and the low temperature end of the lower temperature side area 53*b* can be retained as the general case without the heat transfer member 54. Thus, the lowering of the regenerating effect can be prevented.

(Fifth Embodiment)

Although the displacer type regenerative refrigerator is exemplified in the first embodiment to the fourth embodiment, a pulse tube refrigerator may also be used.

Figure 12:
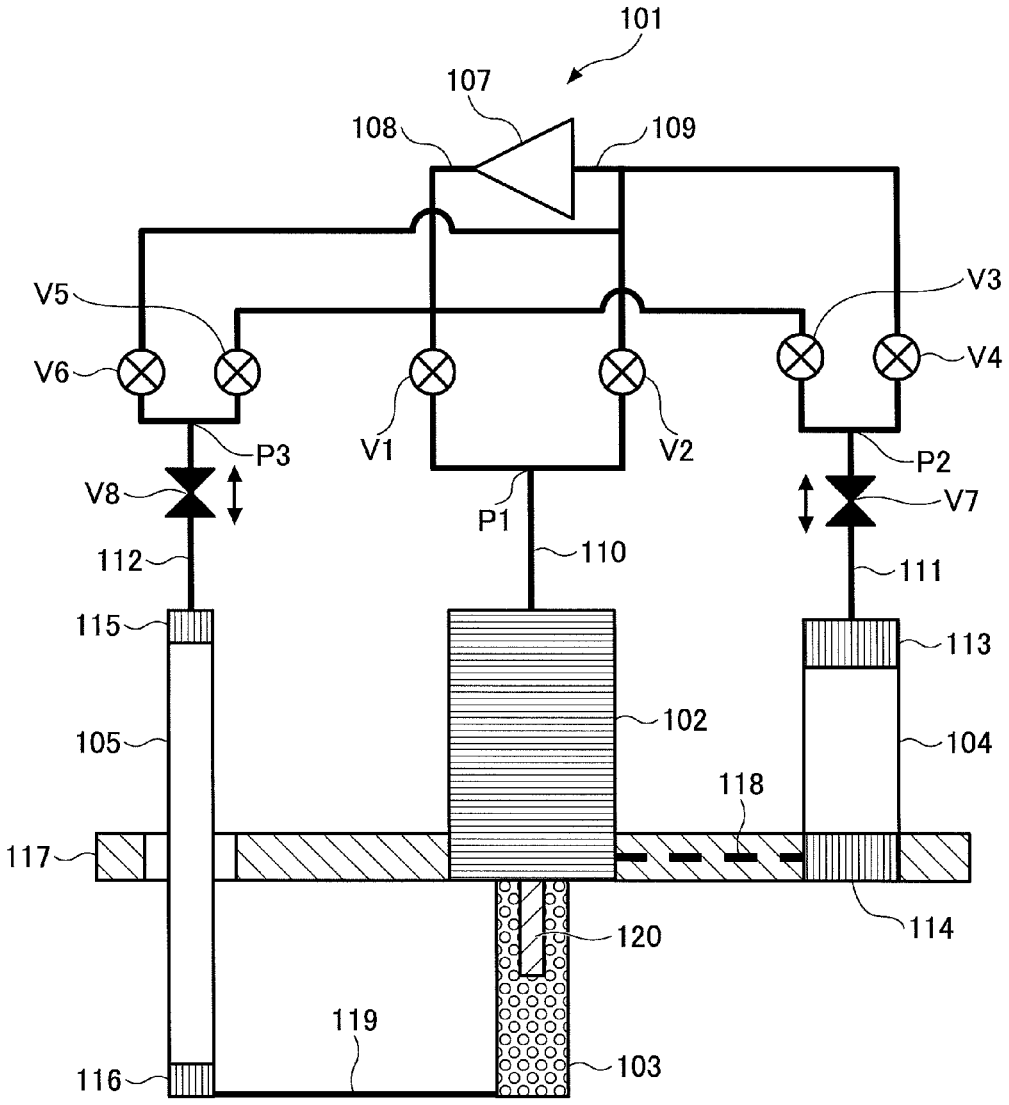
FIG. 12 is a schematic view showing an example of the regenerative refrigerator of a fifth embodiment.

FIG. 12 is a schematic view showing an example of a structure of a pulse tube refrigerator 101 of the embodiment.

The regenerative refrigerator 101 includes a first stage regenerator 102, a second stage regenerator 103, a first stage pulse tube 104, and a second stage pulse tube 105.

Similar to the first regenerator 9 of the first embodiment, the first stage regenerator 102 may be configured such that the high temperature side regenerative material 60 is filled in a cylinder. Similar to the second regenerator 70 of the first embodiment, the second stage regenerator 103 may be configured such that the first regenerative material 62 is filled in a cylinder. The second stage regenerator 103 may have a structure divided into plural areas by separation plates similar as the second regenerator 70 of the first embodiment. For this case, the second regenerative material 66 may be filled in the high temperature side area.

The high temperature ends of the first stage regenerator 102, the first stage pulse tube 104 and the second stage pulse tube 105 are connected to a branch pipe 108 trifurcated from a discharging side of the compressor 107 and a branch pipe 109 trifurcated from a suctioning side of the compressor 107 via the supply-discharge common pipes 110, 111 and 112, respectively.

A regenerator supply valve V1 is provided in the branch pipe 108 at upstream of a first connection point P1 to the supply-discharge common pipe 110, a first stage supply valve V3 is provided in the branch pipe 108 at upstream of a second connection point P2 to the supply-discharge common pipe 111 and a second stage supply valve V5 is provided in the branch pipe 108 at upstream of a third connection point P3 to the supply-discharge common pipe 112.

A regenerator return valve V2 is provided in the branch pipe 109 at downstream of the first connection point P1 from the supply-discharge common pipe 110, a first stage return valve V4 is provided in the branch pipe 109 at downstream of the second connection point P2 from the supply-discharge common pipe 111, and a second stage return valve V6 is provided in the branch pipe 109 at downstream of the third connection point P3 from the supply-discharge common pipe 112.

A flow control valve V7 is provided in the supply-discharge common pipe 111 between the high temperature end of the first stage pulse tube 104 and the second connection point P2, and a flow control valve V8 is provided in the supply-discharge common pipe 112 between the high temperature end of the second stage pulse tube 105 and the third connection point P3. These flow control valves function as a phase adjusting mechanism of a gas-piston generated in each of the pulse tubes. Further, an orifice may be used instead of the flow control valve.

A flow smoother/heat exchanger 113 and a flow smoother/heat exchanger 114 are respectively provided at the high temperature end and the low temperature end of the first stage pulse tube 104. A flow smoother/heat exchanger 115 and a flow smoother/heat exchanger 116 are respectively provided at the high temperature end and the low temperature end of the second stage pulse tube 105.

The low temperature end of the first stage pulse tube 104 and the low temperature end of the first stage regenerator 102 are connected by a first cooling stage 117 in a heat exchangeable manner. The low temperature end of the first stage pulse tube 104 and the low temperature end of the first stage regenerator 102 are connected with each other such that the refrigerant gas is capable of passing therebetween by a first stage low temperature end connecting pipe 118 provided in the first cooling stage 117. The low temperature end of the second stage pulse tube 105 and the low temperature end of the second stage regenerator 103 are connected by a second stage low temperature end connecting pipe 119 such that the refrigerant gas is passing there between.

Further, according to the regenerative refrigerator 101 of the embodiment, although not shown in FIG. 12, a high temperature side area and a lower temperature side area are provided in the second stage regenerator 103 at an upper side and a lower side, respectively, similar to the second regenerator 70 of the second embodiment. The high temperature side area is filled with the first regenerative material 62 which is a non-magnetic material similar to the second embodiment. The lower temperature side area is filled with the second regenerative material 66 which is a magnetic material similar to the second embodiment.

Further, the heat transfer member 120 having a column shape similar to the heat transfer member 33 of the second embodiment is provided in the high temperature side area. The heat transfer member 120 is provided to extend in the axial direction in the high temperature side area.

It means that the heat transfer member 120 is embedded in the first regenerative material 62 in the high temperature side area to be in contact with the first regenerative material 62 and continuously extends in the axial direction. Further, the high temperature end of the heat transfer member 120 is positioned at the lower temperature side than the lower end of the first cooling stage 117 while the low temperature end of the heat transfer member 120 is positioned at the higher temperature side than the upper end of a second cooling stage, not shown in the drawings, which is positioned at the low temperature end of the second stage regenerator 103.

In this embodiment as well, the position of the low temperature end of the heat transfer member 120 in the axial direction is set to be in an area where the specific heat capacity of the helium gas as the refrigerant gas is larger than the specific heat capacity of the first regenerative material 62. Specifically, for example, the position of the low temperature end of the heat transfer member 120 in the axial direction may be within a range more than or equal to 8K and less than or equal to 20K, and more preferably, within a range more than or equal to 8K and less than or equal to 10 and a few more K while the regenerative refrigerator 101 is being operated.

The operation of the regenerative refrigerator 101 is explained.

When the first stage supply valve V3 and the second stage supply valve V5 are opened in the high-pressure refrigerant gas supply process, the refrigerant gas is introduced into the high temperature ends of the first stage pulse tube 104 and the second stage pulse tube 105 via the branch pipe 108 and the supply-discharge common pipe 111 or the supply-discharge common pipe 112.

Further, when the regenerator supply valve V1 is opened, the refrigerant gas from the compressor 107 passes the branch pipe 108 and the supply-discharge common pipe 110 and is introduced into the low temperature end of the first stage pulse tube 104 from the first stage regenerator 102, and then introduced into the low temperature end of the second stage pulse tube 105 via the second stage regenerator 103.

On the other hand, in a return process of the low pressure refrigerant gas, when the first stage return valve V4 or the second stage return valve V6 is opened, the refrigerant gas in the first stage pulse tube 104 or the second stage pulse tube 105 returns to the compressor 107 to be collected from the respective high temperature end via the supply-discharge common pipe 111 or the supply-discharge common pipe 112 and the branch pipe 109. Further, when the regenerator return valve V2 is opened, the refrigerant gas in the first stage pulse tube 104 is collected in the compressor 107 from the low temperature end via the first stage regenerator 102, the supply-discharge common pipe 110 and the branch pipe 109. Similarly, the refrigerant gas in the second stage pulse tube 105 is collected in the compressor 107 via the second stage regenerator 103, the first stage regenerator 102, the supply-discharge common pipe 110 and the branch pipe 109.

In the pulse tube refrigerator 101 of the embodiment, cooling is generated at the low temperature end of the regenerator and the pulse tube by repeating a following first operation and a second operation. In the first operation, the refrigerant gas (for example, helium gas) which is a working fluid compressed by the compressor 107 is introduced into the first stage regenerator 102 and the second stage regenerator 103, and the first stage pulse tube 104 and the second stage pulse tube 105. In the second operation, the working fluid is returned to the compressor 107 from the first stage pulse tube 104 and the second stage pulse tube 105, and the first stage regenerator 102 and the second stage regenerator 103. Further, by contacting an object to be cooled with the low temperature ends of the regenerators and the pulse tubes in a heat exchangeable manner, the object can be cooled.

According to the regenerative refrigerator 101 of the embodiment, the following advantages can be obtained. As described in the first embodiment or the like, by shifting the temperature profile at the intermediate temperature range of the temperature profile from the high temperature end to the low temperature end of the second stage regenerator 103, to the high temperature side, the amount of the helium gas staying in the area can be reduced to increase the pressure difference of the total refrigerator system. Thus, the refrigeration performance can be improved.

Further, as the heat transfer member 120 extends in the axial direction and transmits the heat from the high temperature end to the low temperature end of the heat transfer member 120, the temperature of the first cooling stage 117 can be decreased to improve the refrigeration performance of the first stage regenerator 102. Further, by controlling the provided position of the heat transfer member 120, the temperature profile in the vicinity of the high temperature end and the low temperature end of the second stage regenerator 103 can be retained as the general structure without the heat transfer member 120. Thus, the degradation of the regenerating effect can be prevented and the refrigeration performance of the first stage regenerator 102 can be improved while the refrigeration performance of the second stage regenerator 103 is maintained.

In this embodiment, an example in which the heat transfer member is positioned inside the regenerator is explained. Alternatively, similar to the third embodiment, the heat transfer member may be provided to surround the regenerative material. Further, similar to the fourth embodiment, a single stage pulse tube may be used.

(Sixth Embodiment)

Figure 13:
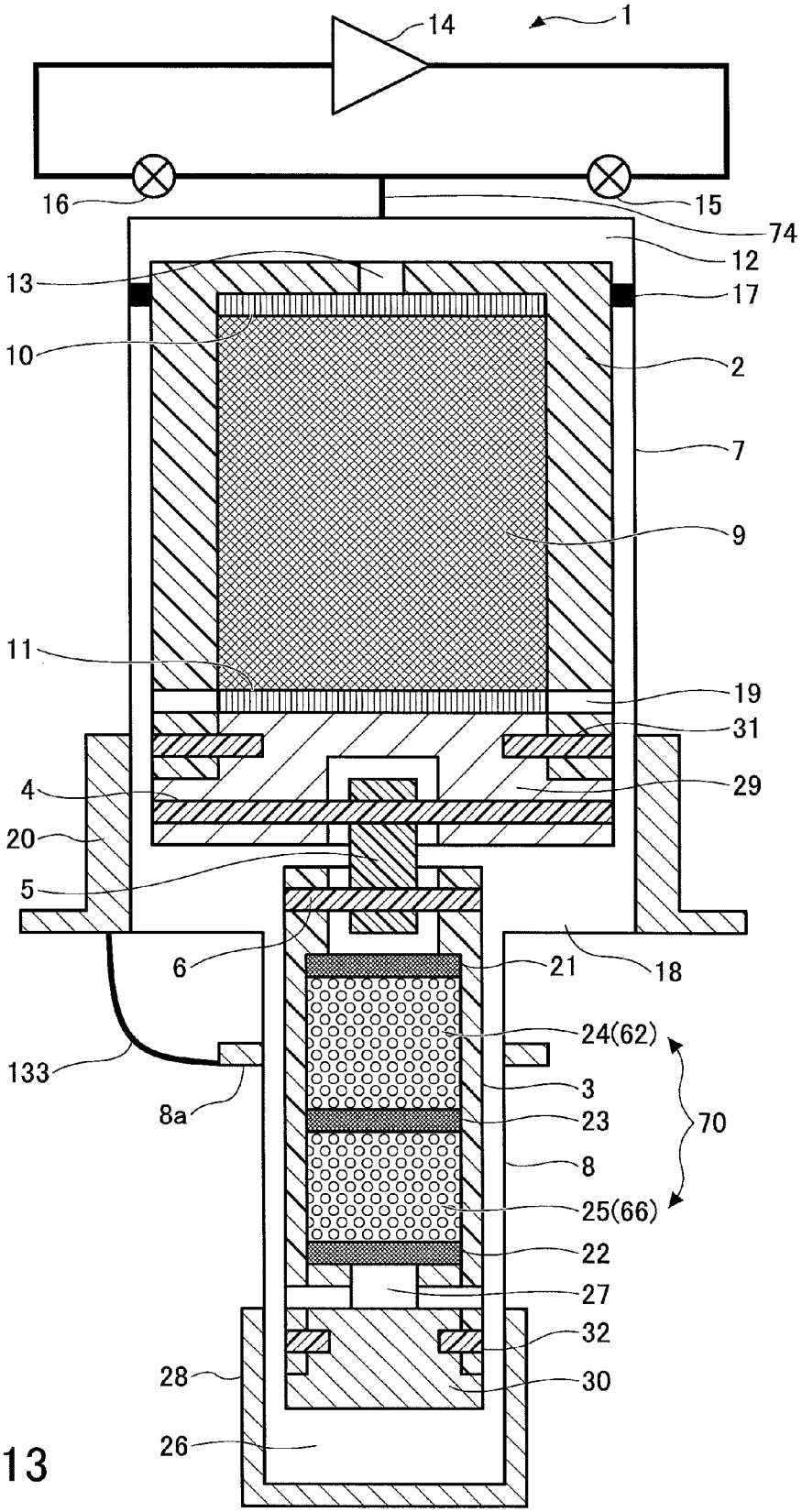
FIG. 13 is a schematic view showing an example of the regenerative refrigerator of a sixth embodiment.

FIG. 13 is a perspective view showing an example of a structure of the regenerative refrigerator 1 of the embodiment.

The regenerative refrigerator 1 has the same structure as the regenerative refrigerator 1 as described above with reference to FIG. 1 in this embodiment as well. In this embodiment, similar to the second embodiment, the regenerative refrigerator 1 includes a temperature rising member which raises the temperature profile in the second regenerator 70. However, the structure of the heat transfer member functioning as the temperature rising member is different from that of the second embodiment.

As shown in FIG. 13, in this embodiment, the regenerative refrigerator 1 is configured to include a cooling extracting portion 8*a* at a position corresponding to the high temperature side area 24 in the second displacer 3 in the axial direction and at an outer peripheral of the second cylinder 8. Further, the regenerative refrigerator 1 includes a heat transfer member 133 composed of a linear member connecting the cooling extracting portion 8*a* and the first cooling stage 20 in a heat exchangeable manner. For the heat transfer member 133, a material capable of transmitting heat larger than that by the second regenerator 70 in the axial direction, in other words, a material having a coefficient of thermal conductivity larger than that of the first regenerative material 62 is used. The heat transfer member 133 may be made of a material similar to the heat transfer member 33 of the second embodiment. Specifically, a material having a high thermal conductivity such as copper, aluminum, the alloy thereof or the like may be used as the heat transfer member 133. Further, for the heat transfer member 133, a material having a coefficient of thermal conductivity larger than that of a material composing a sidewall (second displacer 3) of the second regenerator 70 may be used. Further, for example, when lead is used as the first regenerative material 62 or the like, for example, bismuth or an alloy of bismuth and copper, aluminum or the like may be used as the heat transfer member 133.

The heat transfer member 133 is provided outside the first cylinder 7 and the second cylinder 8 which respectively compose the first expansion space 18 and the second expansion space 26 to connect different positions in the axial direction. Further, as can be understood from FIG. 13, the high temperature end of the heat transfer member 133 is positioned at the lower end of the first cooling stage 20 while the low temperature end of the heat transfer member 133 is positioned at the higher temperature side than the upper end of the second cooling stage 28.

The position of the heat transfer member 133 in the axial direction corresponding to the high temperature side area 24 is determined based on a temperature distribution in the high temperature side area 24 when the regenerative refrigerator 1 is being normally operated. In this embodiment, the low temperature end of the heat transfer member 133 may be positioned at the higher temperature side for a predetermined distance from the separation plate 23. Further, the high temperature end of the heat transfer member 133 may be positioned at a higher temperature side than the gas flow regulator 21.

Similar to the heat transfer member 33 or the like of the second embodiment, for example, the position of the low temperature end of the heat transfer member 133 in the axial direction is set to be in an area where the specific heat capacity of the helium gas as the refrigerant gas is larger than the specific heat capacity of the first regenerative material 62. Specifically, for example, the position of the low temperature end of the heat transfer member 133 in the axial direction may be within a range more than or equal to 8K and less than or equal to 20K, and more preferably, within a range more than or equal to 8K and less than or equal to 10 and a few more K while the regenerative refrigerator 1 is being operated. In this embodiment, the low temperature end of the heat transfer member 133 in the axial direction may be, for example, at 8K. Further, the provided position of the heat transfer member 133 may be controlled as follows. The temperature profile in the second regenerator 70 becomes high at the temperature range in which the specific heat capacity and the difference in density between high and low pressures of the refrigerant gas become relatively high. At the same time, the temperature profile at the temperature ranges of the high temperature end and the low temperature end can be retained similar as the general regenerator so that the regenerating effect in the second regenerator 70 can be maintained.

According to the regenerative refrigerator 1 and the second regenerator 70 of the embodiment, the following advantages can be obtained. The temperature profile from the high temperature end to the low temperature end of the high temperature side area 24 shows a tendency to be in inverse proportion with respect to the distance from the high temperature end as a hyperbola profile (see FIG. 2). In this embodiment, by providing the heat transfer member 133, the heat from the high temperature side of the high temperature side area 24 can be effectively transmitted to the lower temperature side via the heat transfer member 133. Thus, similar to that explained above with reference to FIG. 2, the temperature profile in the second regenerator 70 can be shifted to the high temperature side compared with a case where the heat transfer member 133 is not provided at an intermediate temperature range of the temperature profile in the second regenerator 70. By the increasing of the temperature profile in the high temperature side area 24, the amount of the helium gas staying in the area is reduced to increase the pressure difference of the total refrigerator system. Thus, the refrigeration performance can be increased.

Further, as the heat is transmitted from the first cooling stage 20 to the cooling extracting portion 8*a* via the heat transfer member 133 provided outside, the temperature of the first cooling stage 20 can be decreased to improve the refrigeration performance of the first stage of the first regenerator 9.

Further, by controlling the provided position of the heat transfer member 133, the temperature profile in the vicinity of the high temperature end and the low temperature end of the second regenerator 70 can be retained as the general structure without the heat transfer member 133. Thus, the refrigeration performance of the first cooling stage 20 can be improved while maintaining the refrigeration performance of the second cooling stage 28. Further, by providing the heat transfer member 133 as an external member, the connecting position, especially at the low temperature end in the axial direction, can be easily adjusted so that the temperature of the first cooling stage 20 can be easily adjusted.

Although the heat transfer member 133 made of a linear member is exemplified in FIG. 13, the structure of the heat transfer member 133 may be arbitrarily determined in accordance with a manufacturing easiness, a way of offsetting the temperature profile, in other words, a degree of the heat exchange with the first regenerative material 62 or the refrigerant gas. For example, the cross-sectional area of the heat transfer member 133 or the number of the members may be arbitrarily adjusted.

Figure 14:
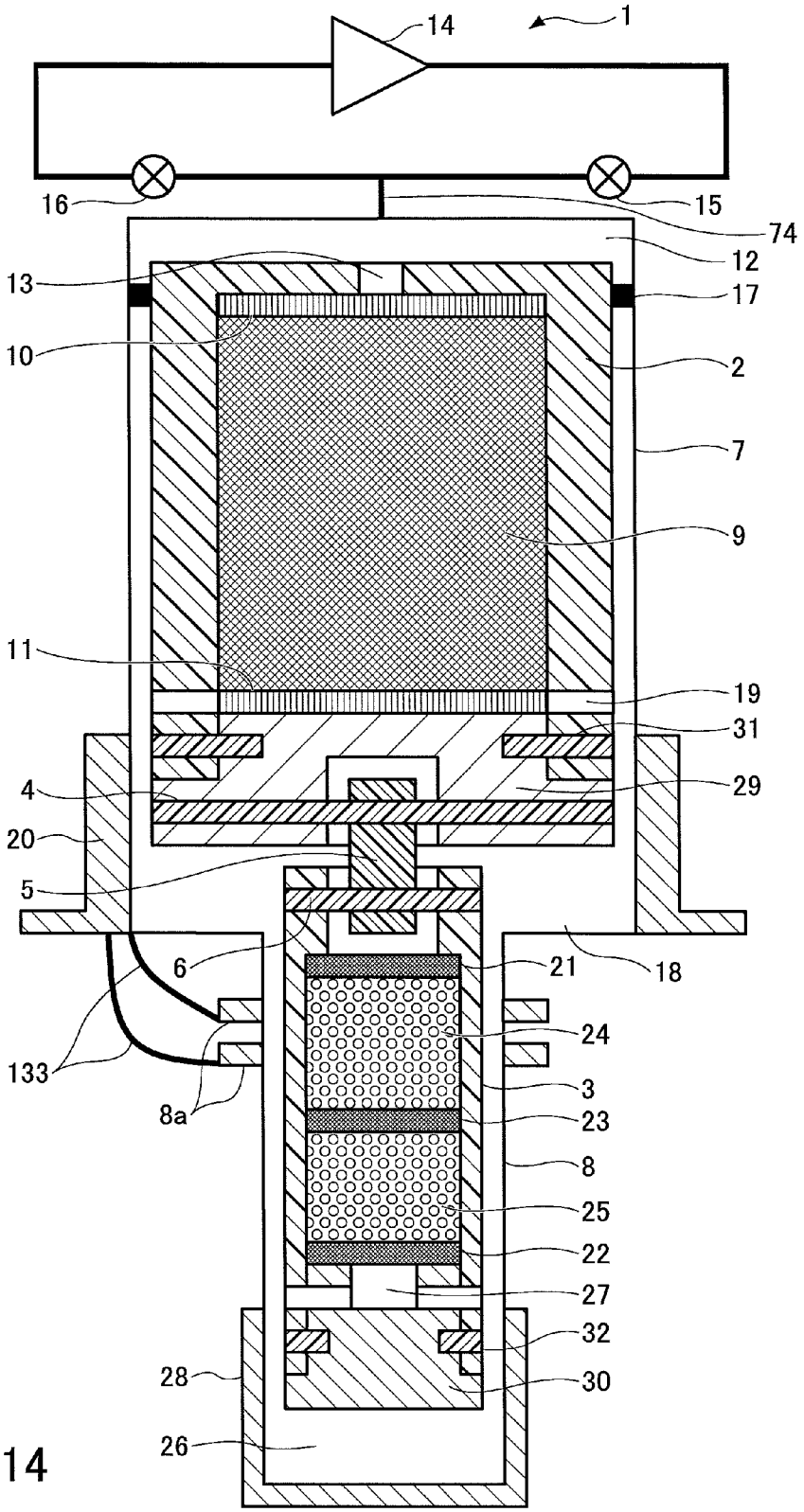
FIG. 14 is a schematic view showing another example of the regenerative refrigerator of the sixth embodiment.

FIG. 14 is a schematic view showing another example of the structure of the regenerative refrigerator 1 of the embodiment. The regenerative refrigerator 1 may be configured to include plural, two for example, heat transfer members 133. For this case, plural cooling extracting portions 8*a* may be provided at the outside of the second cylinder 8 at different positions in the axial direction. The two cooling extracting portions 8*a* corresponding to the two heat transfer members 133 may be provided in parallel at the outer peripheral surface of the second cylinder 8 in the axial direction. The two cooling extracting portions 8*a* may be provided in parallel at the same position in the axial direction at different positions in the circumferential direction. For this case, the cross sectional area of each of the heat transfer members 133 may be set to be smaller than that of the heat transfer member 133 shown in FIG. 13 considering a balance between the total heat capacity of the plural heat transfer members 133 and the volume and the heat capacity of the second regenerative material.

Figure 15:
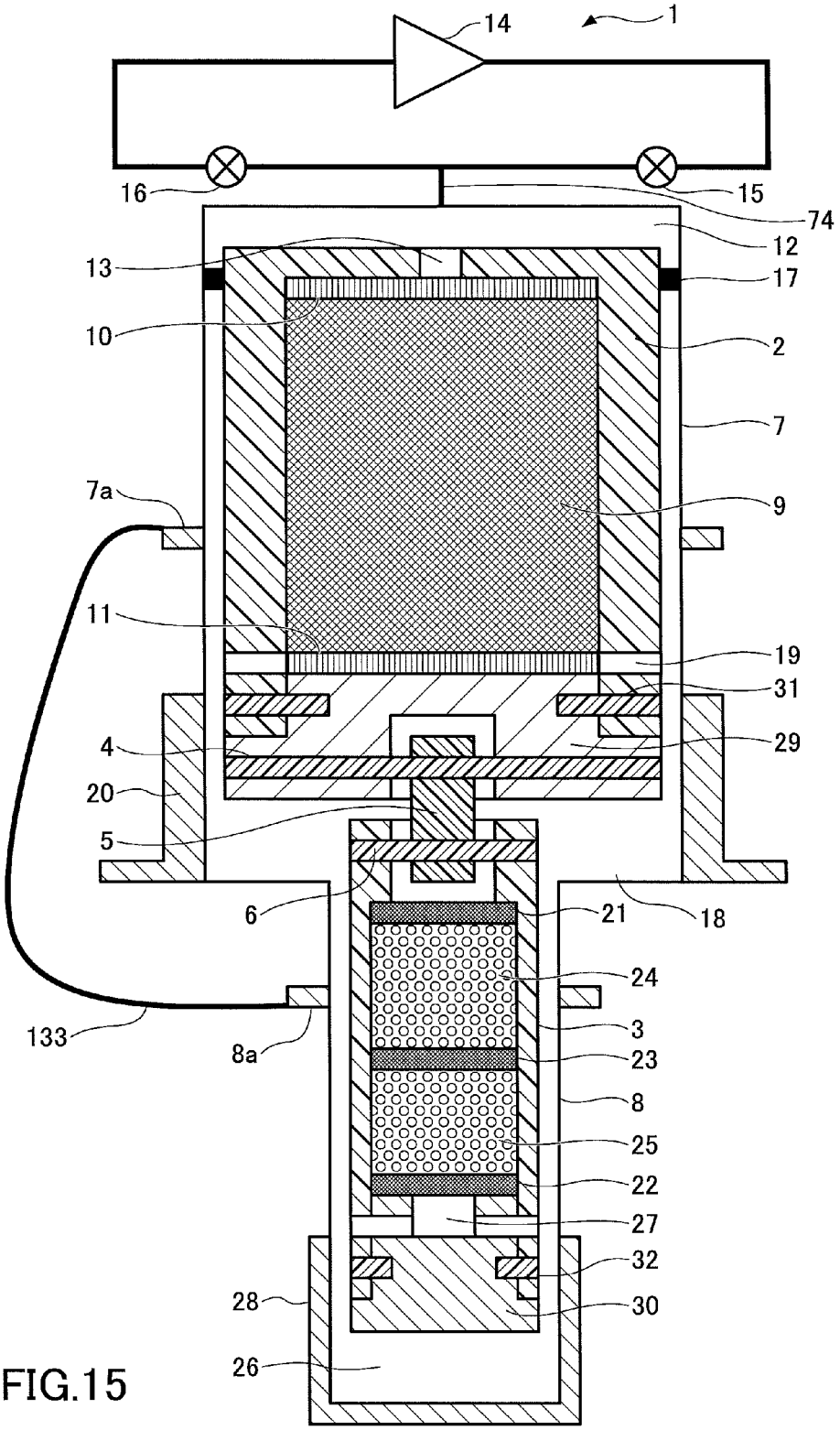
FIG. 15 is a schematic view showing another example of the regenerative refrigerator of the sixth embodiment.
Figure 16:
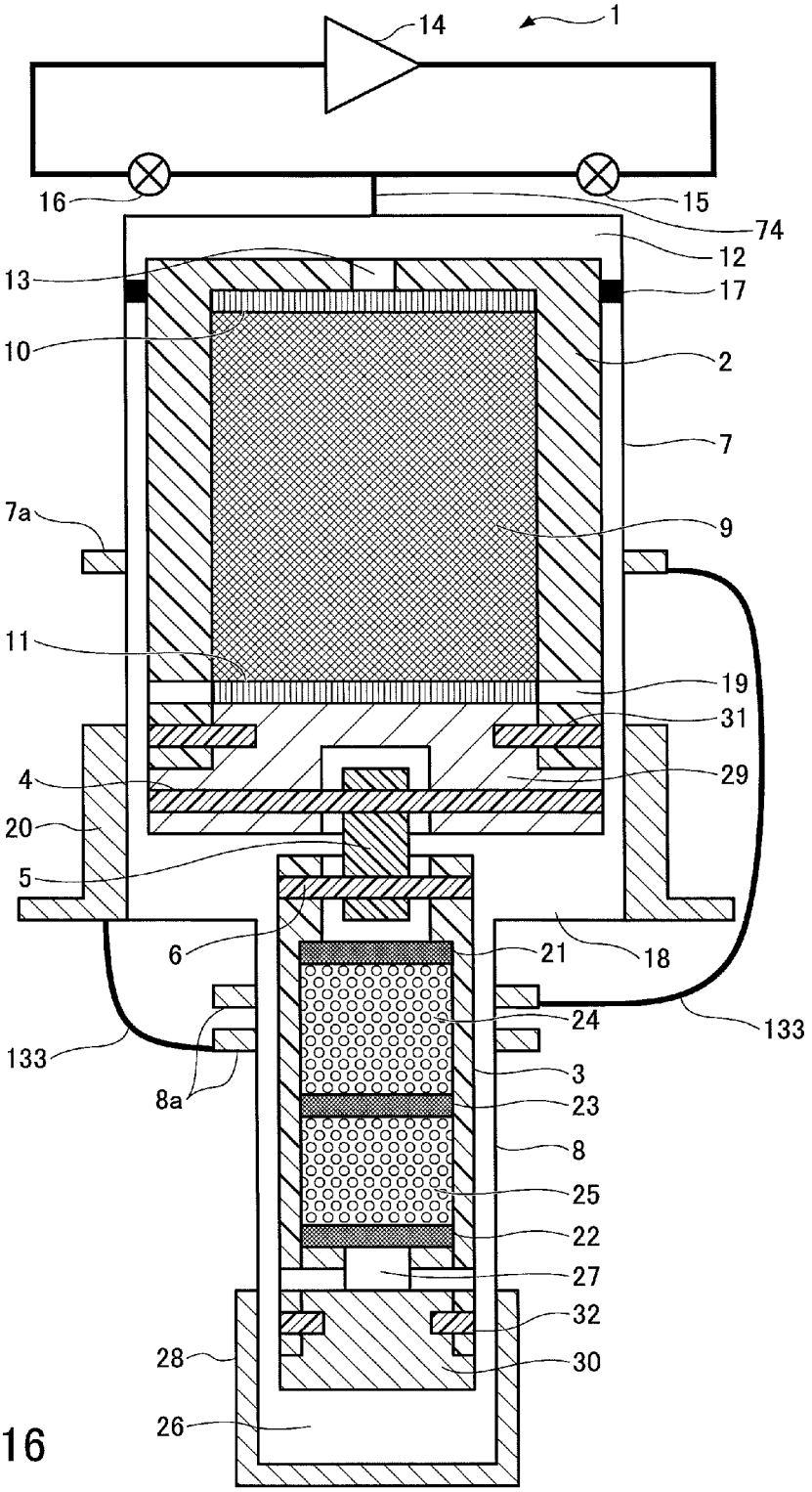
FIG. 16 is a schematic view showing another example of the regenerative refrigerator of the sixth embodiment.

FIG. 15 is a schematic view showing another example of the structure of the regenerative refrigerator 1 of the embodiment. In this example, the heat transfer member 133 may be connected to a position at the higher temperature side than the first cooling stage 20 of the first cylinder 7. At this time, a cooling obtaining portion 7*a* is provided at a corresponding position of the first cylinder 7. For this structure, the cooling transmitted from the cooling extracting portion 8*a* of the second cylinder 8 via the heat transfer member 133 is directly introduced into the first regenerator 9 of the first cylinder 7. The first regenerator 9 is cooled by this and as a result, the temperature of the first cooling stage 20 can be lowered. Further, as shown in FIG. 16, the transfer member 133 shown in FIG. 13 and the transfer member 133 shown in FIG. 15 may be combined.

(Seventh Embodiment)

The heat transfer member 133 may be provided along the outer peripheral surface of the second cylinder 8.

Figure 17:
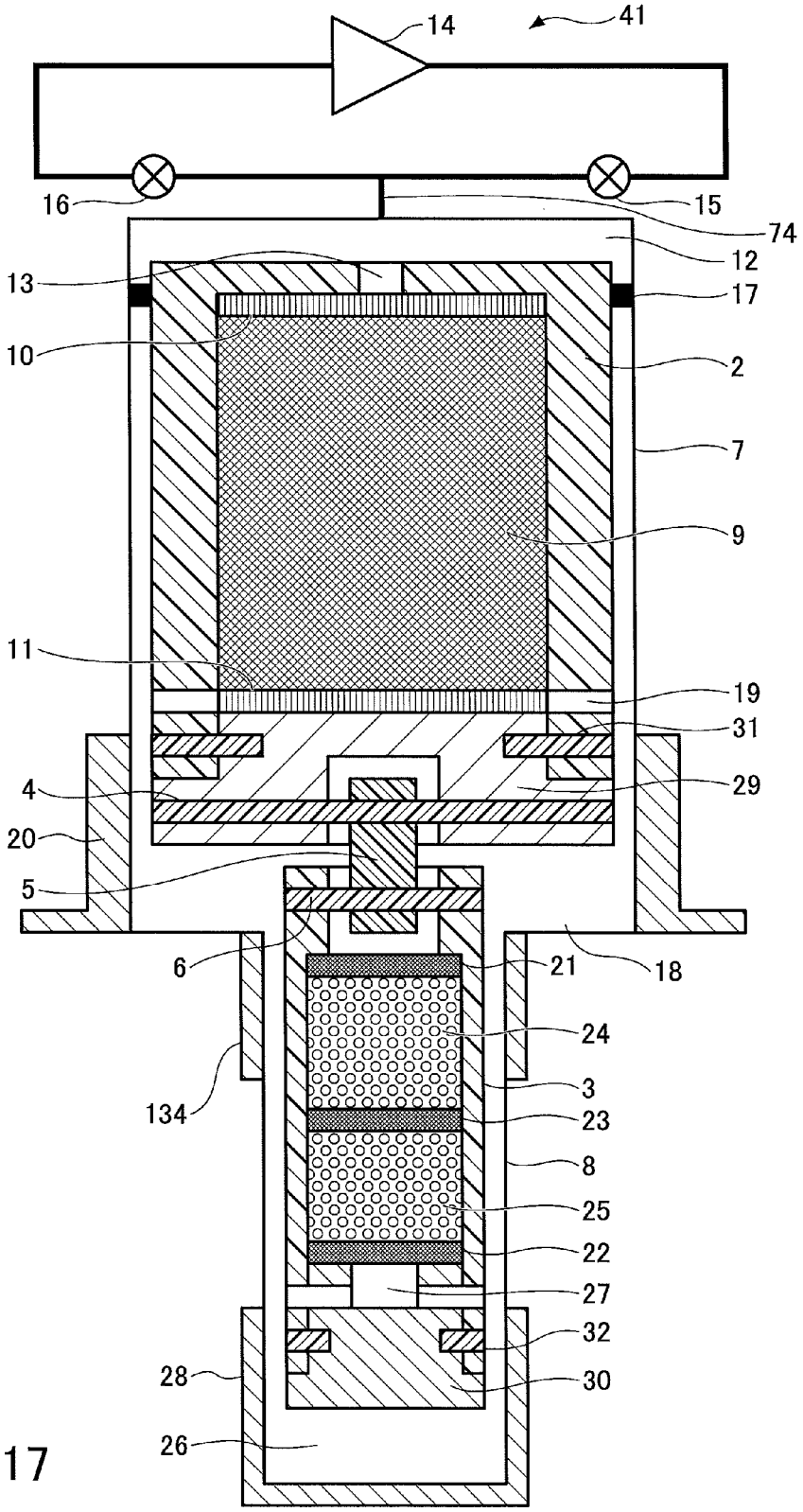
FIG. 17 is a schematic view showing an example of the regenerative refrigerator of a seventh embodiment.

FIG. 17 is a schematic view showing an example of a structure of a regenerative refrigerator 41 of the embodiment.

As the regenerative refrigerator 41 of the embodiment has the same function, the same operation and the basic structural components for the refrigerator as the regenerative refrigerator 1 of the first embodiment, the same components are given the same reference numerals, and explanations are not repeated.

The regenerative refrigerator 41 of the embodiment includes a circular cylinder shaped (hollow annulus shaped) heat transfer member 134 which surrounds an area of the second cylinder 8 from the high temperature end of the second cylinder 8 to a position at the higher temperature end than the low temperature end of the high temperature side area 24. The outer peripheral surface shape of the heat transfer member 134 is formed to have a diameter larger for an amount equal to the thickness of the heat transfer member 134 than the outer peripheral surface shape of the second cylinder 8. The high temperature end of the heat transfer member 134 is connected to a bottom surface portion of the first cylinder 7, which is the low temperature end. The heat transfer member 134 may be made of a material similar to the heat transfer member 133 or the like explained in the sixth embodiment.

In this embodiment, the high temperature end of the heat transfer member 134 may be positioned at a substantially same position with respect to the lower end of the first cooling stage 20 in the axial direction. Further, in this embodiment as well, the position of the low temperature end of the heat transfer member 134 in the axial direction may be within a range more than or equal to 8K and less than or equal to 20K during the normal operation of the regenerative refrigerator 41, for example, and more preferably, within a range more than or equal to 8K and less than or equal to 10 and a few more K. The provided position of the heat transfer member 134 may also be controlled similar to the heat transfer member 133. With this, the advantages same as those of the sixth embodiment can be obtained. According to the structure of the embodiment, the temperature of the first cooling stage 20 can be lowered more effectively based on the transmitting operation of the cooling by the heat transfer member 134 in the axial direction.

(Eighth Embodiment)

Similar to the fourth embodiment, a single stage regenerative refrigerator may be used.

Figure 18:
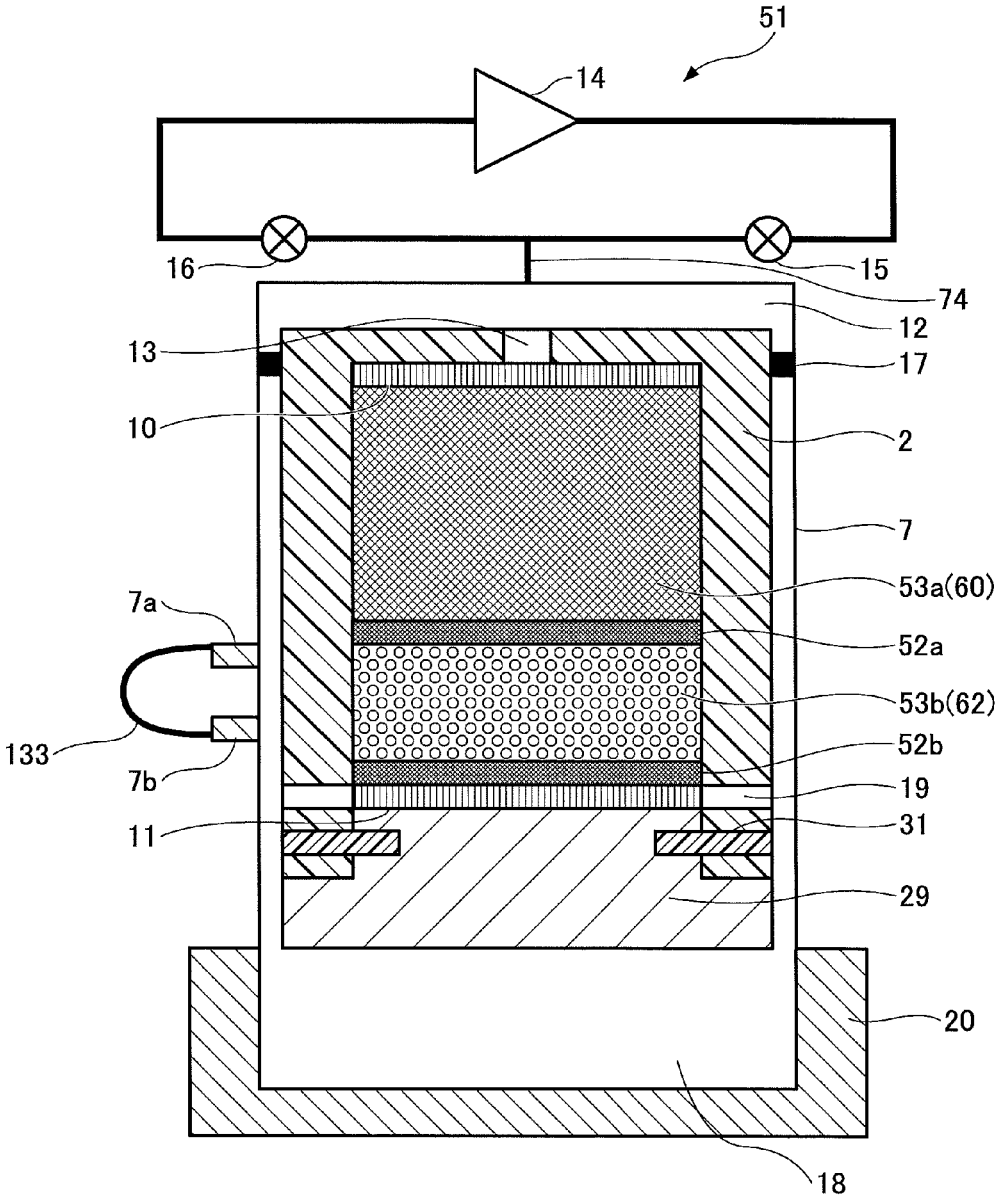
FIG. 18 is a schematic view showing an example of the regenerative refrigerator of an eighth embodiment.

FIG. 18 is a perspective view showing an example of a structure of a regenerative refrigerator 51 of the embodiment. In this embodiment, the regenerative refrigerator 51 has the same structure as that of the regenerative refrigerator 51 of the fourth embodiment explained with reference to FIG. 11.

In this embodiment, a cooling obtaining portion 7*a* and a cooling extracting portion 7*b* are provided at two different positions in the axial direction, a high temperature side and a lower temperature side, respectively, at an outer peripheral surface of the cylinder 7 which is positioned at an outer peripheral of the lower temperature side area 53*b* in which the first regenerative material 62 exists. Further, a heat transfer member 133 which is a linear member connecting the cooling obtaining portion 7*a* and the cooling extracting portion 7*b* is provided at the cylinder 7. In this embodiment, the high temperature end of the heat transfer member 133 is apart from the upper side separation plate 52*a* and the low temperature end of the heat transfer member 133 is apart from the lower side separation plate 52*b* in the axial direction. In this embodiment as well, the position of the low temperature end of the heat transfer member 133 in the axial direction may be within a range more than or equal to 8K and less than or equal to 20K, and more preferably, within a range more than or equal to 8K and less than or equal to 10 and a few more K while the regenerative refrigerator 51 is being operated. Further, in this embodiment as well, the provided position of the heat transfer member 133 may be controlled similarly as the sixth embodiment. With this, the same advantages as the sixth embodiment or the like can be obtained.

According to the present embodiment, the cooling is transmitted from the low temperature end to the high temperature end of the heat transfer member 133 and the regenerative material inside the lower temperature side area 53*b* at the higher temperature side than the heat transfer member 133 is cooled so that the refrigeration capacity of the entirety of the refrigerator can be increased.

(Ninth Embodiment)

Similar to the fifth embodiment, a pulse tube refrigerator may be used.

Figure 19:
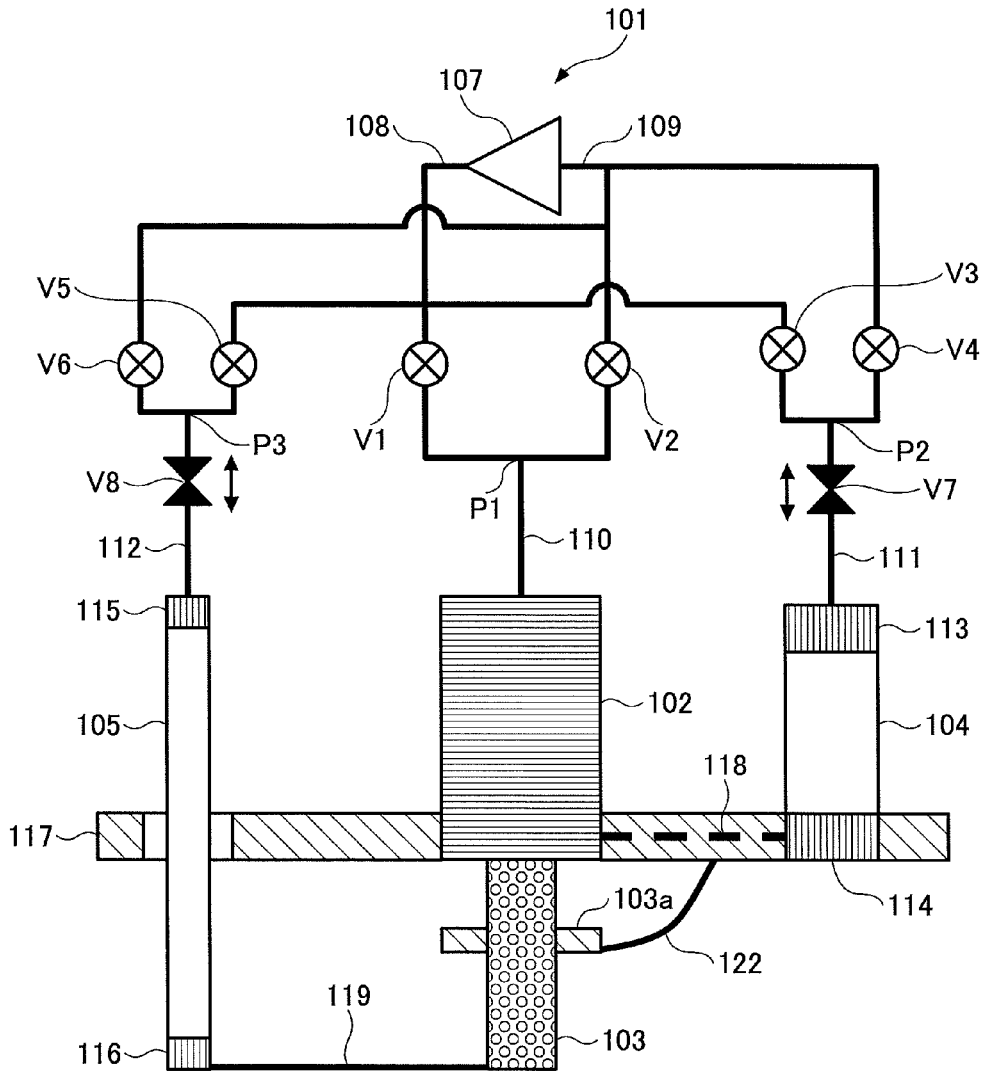
FIG. 19 is a schematic view showing an example of the regenerative refrigerator of a ninth embodiment.

FIG. 19 is a schematic view showing an example of a structure of a pulse tube refrigerator 101 of the embodiment. In this embodiment, the regenerative refrigerator 101 has the same structure as that of the regenerative refrigerator 101 of the fifth embodiment explained with reference to FIG. 12.

Further, for the regenerative refrigerator 101 of the embodiment, although not shown in FIG. 19, similar to the second regenerator 70 of the second embodiment, a high temperature side area and a lower temperature side area are provided at an upper portion and a lower portion in the second stage regenerator 103 respectively. The high temperature side area is filled with the first regenerative material 62 which is a non-magnetic material similar to the second embodiment. The lower temperature side area is filled with the second regenerative material 66 which is a magnetic material similar to the second embodiment. Further, a cooling extracting portion 103*a* is provided at a cylinder which composes an outer peripheral surface of the second stage regenerator 103 corresponding to a position of the high temperature side area in the axial direction. The cooling extracting portion 103*a* and the first cooling stage 117 are connected via a heat transfer member 122 in a heat exchangeable manner. Similar to the sixth embodiment, the heat transfer member 122 is composed of a linear member made of a material having a high thermal conductivity such as copper, aluminum or the like, for example.

The high temperature end of the heat transfer member 122 is positioned at the lower end of the first cooling stage 117 while the low temperature end of the heat transfer member 122 is positioned at the higher temperature side than the upper end of the second cooling stage, not shown in the drawings, at the low temperature end of the second stage regenerator 103.

In this embodiment as well, the position of the low temperature end of the heat transfer member 122 in the axial direction is set to be in an area where the specific heat capacity of the helium gas as the refrigerant gas is larger than the specific heat capacity of the first regenerative material 62. Specifically, for example, the position of the low temperature end of the heat transfer member 122 in the axial direction may be within a range more than or equal to 8K and less than or equal to 20K, and more preferably, within a range more than or equal to 8K less than or equal to 10 and a few more K while the regenerative refrigerator 101 is being operated.

According to the regenerative refrigerator 101 of the embodiment, the following advantages can be obtained. As described in the sixth embodiment or the like, the temperature profile in the second stage regenerator 103 from the high temperature end to the low temperature end can be shifted to the high temperature side at the intermediate temperature range. Thus, the amount of the helium gas staying at the area can be reduced to increase the pressure difference of the total refrigerator system. Thus, the refrigeration performance can be improved.

Further, as the heat transfer member 122 extends in the axial direction and transmits the heat from the high temperature end to the low temperature end of the heat transfer member 122, the temperature of the first cooling stage 117 can be decreased to improve the refrigeration performance of the first stage regenerator 102. Further, by controlling the provided position of the heat transfer member 122, the temperature profile in the vicinity of the high temperature end and the low temperature end of the second stage regenerator 103 can be retained as the general case without the heat transfer member 122. Thus, the lowering of the regenerating effect can be prevented and the refrigeration performance of the first stage regenerator 102 can be improved while retaining the refrigeration performance of the second stage regenerator 103.

Figure 20:
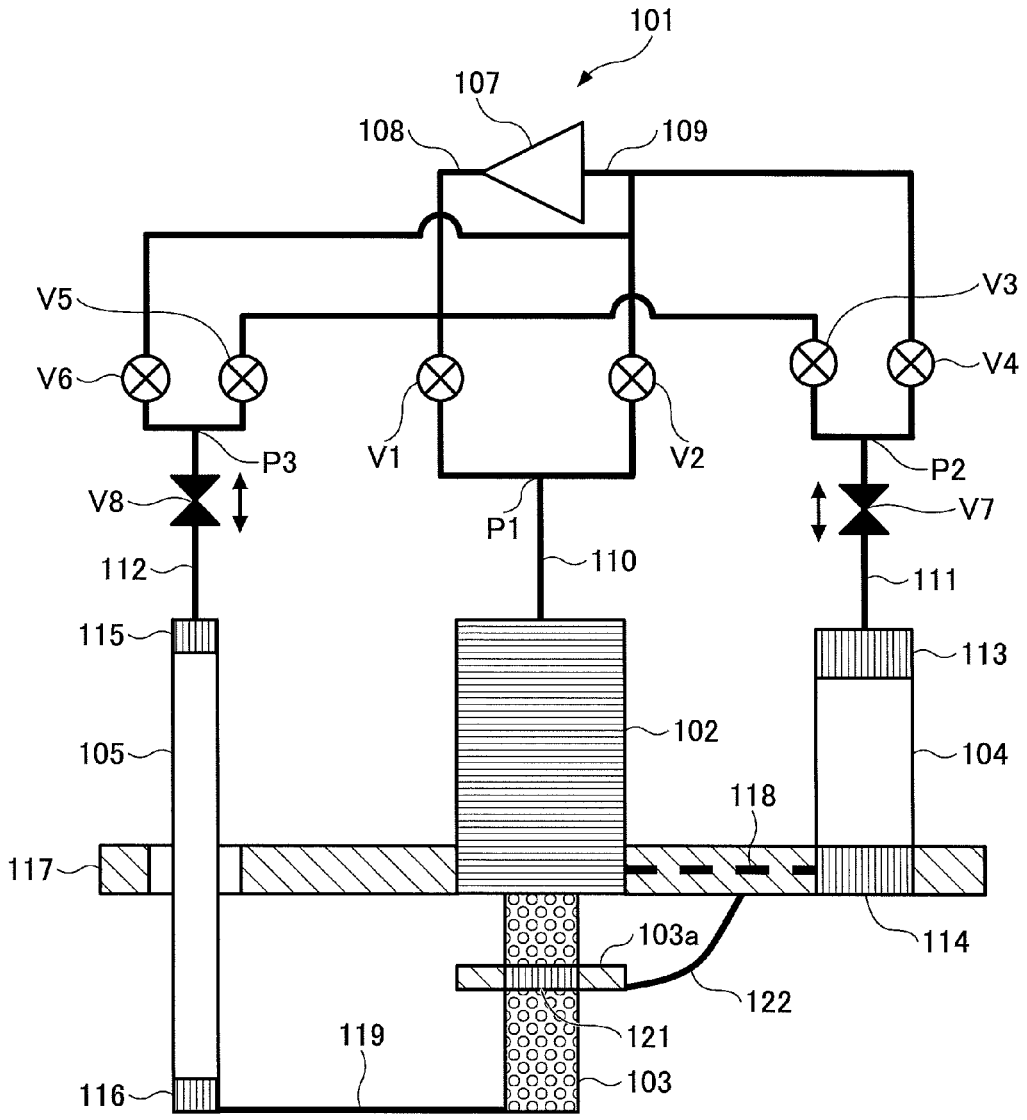
FIG. 20 is a schematic view showing another example of the regenerative refrigerator of the ninth embodiment.

Further, in this embodiment as well, as shown in FIG. 20, the flowing speed of the refrigerant gas passing within the high temperature side area of the second stage regenerator 103 tends to be lower as being apart from the center in the radius direction. Thus, a heat exchanger 121 provided with plural through holes may be provided at an inner peripheral side of the cooling extracting portion (not shown in the drawings) corresponding to the heat transfer member 122. With this, the temperature of the first cooling stage 117 can be effectively lowered so that the regenerating efficiency can be increased. Further, in the ninth embodiment as well, similar to the eighth embodiment, a single stage pulse tube refrigerator may be used.

Figure 21:
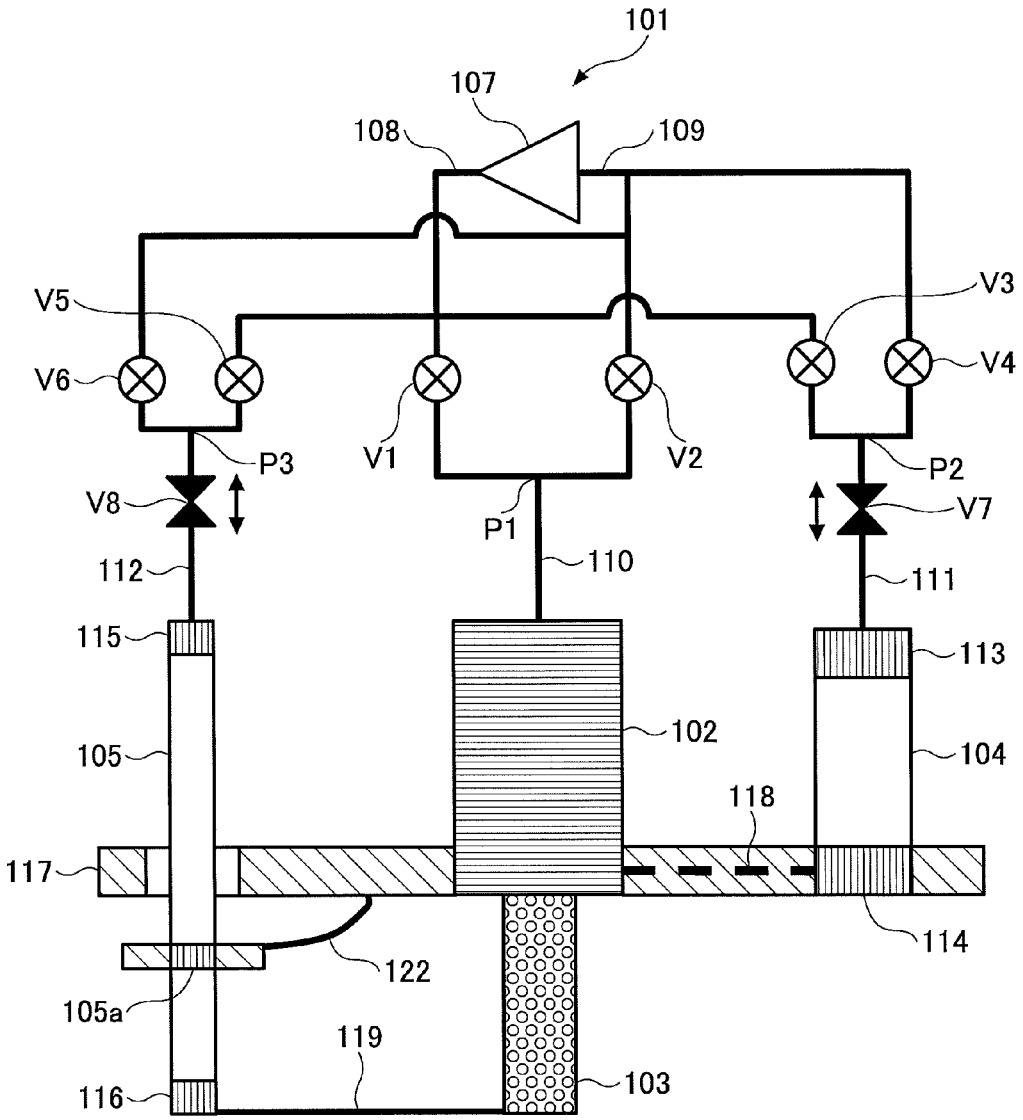
FIG. 21 is a schematic view showing another example of the regenerative refrigerator of the ninth embodiment.

In addition to the configurations shown in FIG. 19 and FIG. 20, the heat transfer member 122 of the pulse tube refrigerator 101 may have a configuration as shown in FIG. 21. As shown in FIG. 21, a cooling extracting portion 105*a* may be provided at an outer peripheral surface of the second stage pulse tube 105, which is one of expanders, and the heat transfer member 122 may be configured to connect the cooling extracting portion 105*a* and the first cooling stage 117.

Although a preferred embodiment of the regenerative refrigerator has been specifically illustrated and described, it is to be understood that minor modifications may be made therein without departing from the spirit and scope of the invention as defined by the claims.

The present invention is not limited to the specifically disclosed embodiments, and variations and modifications may be made without departing from the scope of the present invention.

For example, in the above described regenerative refrigerators, the refrigerator of two stages or a single stage as exemplified. Alternatively, the refrigerator may be of three of more stages. Further, in the above embodiments, examples where the regenerative refrigerator is a displacer type GM refrigerator or a pulse tube refrigerator are explained. However, it is not limited so. For example, the present invention is adoptable for a Stirling refrigerator, a Solvay refrigerator or the like.

Further, the structures of the embodiments may be arbitrarily combined, for example, the structure of the first regenerative material 62 of the first embodiment may be combined with the temperature rising member of the second embodiment to ninth embodiment or the like. Further, for the first embodiment, a single stage, or a pulse tube refrigerator may be used.

According to the above embodiments, the temperature profile in the regenerator is selectively increased at a predetermined temperature range at which the specific heat capacity and the difference in density between high and lower pressures of the refrigerant gas become relatively high. At the same time, the temperature profile at the temperature ranges of the high temperature end and the low temperature end can be retained similar as the general regenerator so that the regenerating effect in the regenerator can be retained. Therefore, the regenerating efficiency of the regenerative refrigerator can be increased.

Further, the following embodiments are also included.

A regenerative refrigerator which includes a regenerator including a regenerative material and extending in an axial direction, and a heat transfer member being in contact with the regenerative material at adjacent thereof and extending in the axial direction.

In the regenerative refrigerator, the heat transfer member may be positioned inside the regenerator.

In the regenerative refrigerator, the heat transfer member may be continuously provided in the axial direction.

In the regenerative refrigerator, the heat transfer member may be discretely provided in the axial direction.

In the regenerative refrigerator, the heat transfer member may be in a form of surrounding the regenerative material.

The regenerative refrigerator may include plural cooling stages, and the heat transfer member may be provided between two cooling stages among the plural cooling stages.

In the regenerative refrigerator, a low temperature end of the heat transfer member may be positioned at an area where the specific heat capacity of a refrigerant becomes larger than the specific heat capacity of the regenerative material.

In the regenerative refrigerator, the regenerator may include a high temperature side area in which a regenerative material made of a non-magnetic material is included and a lower temperature side area in which a regenerative material made of a magnetic material is included, and the heat transfer member may be provided at the high temperature side area.

A regenerator including a regenerative material and extending in an axial direction includes a heat transfer member which is at adjacent to the regenerative material and extends in the axial direction.

A regenerative refrigerator which includes a expander including a cylinder for housing a regenerative material, an expansion space which expands a refrigerant gas flowing inside the cylinder, and a heat transfer member connecting two positions of the expander whose temperatures are different from each other at an outside of the expander in a heat exchangeable manner.

In the regenerative refrigerator, a low temperature end and a high temperature end of the heat transfer member may be connected to different positions of the cylinder in the axial direction.

In the regenerative refrigerator, the low temperature end of the heat transfer member may be connected to an outer peripheral of the cylinder.

In the regenerative refrigerator, the low temperature end of the heat transfer member may be connected to an outer peripheral of the cylinder at an area where the specific heat capacity of the refrigerant gas flowing in the cylinder becomes larger than the specific heat capacity of the regenerative material.

In the regenerative refrigerator, the cylinder may include a high temperature side area in which a regenerative material made of a non-magnetic material is included and a lower temperature side area in which a regenerative material made of a magnetic material is included, and the low temperature end of the heat transfer member may be connected to an outer peripheral of the cylinder at the high temperature side area.

In the regenerative refrigerator, the cylinder may includes a first cooling stage and a second cooling stage which is cooled to be a temperature lower than that of the first cooling stage, and the high temperature end of the heat transfer member may be connected to the first cooling stage.

In the regenerative refrigerator, the high temperature end of the heat transfer member may be connected to an outer peripheral of the cylinder at a different position from the low temperature end in the axial direction.

In the regenerative refrigerator, the heat transfer member may have a hollow annulus shape surrounding the regenerative material.

In the regenerative refrigerator, the expander may further include a pulse tube, and the low temperature end of the heat transfer member may be connected to an outer peripheral of the pulse tube.

The present application is based on and claims the benefit of priority of Japanese Priority Application No. 2012-085943 filed on Apr. 4, 2012, and Japanese Priority Application No. 2012-085944 filed on Apr. 4, 2012, the entire contents of which are hereby incorporated by reference.

What is claimed is:

1. A regenerative refrigerator comprising:

an expander which includes a regenerator including a regenerative material and an expansion space for expanding a refrigerant gas flowing in the regenerator, the regenerator being configured such that a temperature profile at a predetermined temperature range in the regenerator is selectively higher than a reference case in which lead is used as the regenerative material.

2. A regenerative refrigerator comprising:

an expander which includes a regenerator including a regenerative material and an expansion space for expanding a refrigerant gas flowing in the regenerator; and a temperature rising member which selectively raises a temperature profile at a predetermined temperature range in the regenerator, wherein the temperature rising member is a heat transfer member composed of a material having a coefficient of thermal conductivity larger than that of the regenerative material.

3. The regenerative refrigerator according to claim 2, wherein the heat transfer member is provided inside the regenerator.

4. The regenerative refrigerator according to claim 3, wherein the heat transfer member is continuously or discretely provided in an axial direction of the expander.

5. The regenerative refrigerator according to claim 2, wherein the heat transfer member is formed to surround the regenerative material.

6. The regenerative refrigerator according to claim 2, wherein the heat transfer member is provided to increase the temperature profile at the temperature range in which the specific heat capacity of the refrigerant gas becomes a peak in the regenerator.

7. The regenerative refrigerator according to claim 2, wherein the regenerator includes a high temperature side area including a first regenerative material composed of a non-magnetic material and a lower temperature side area including a second regenerative material composed of a magnetic material, and the heat transfer member is provided in the high temperature side area.

8. The regenerative refrigerator according to claim 2, wherein the heat transfer member is made of copper, aluminum, bismuth or the alloy thereof.

9. A regenerative refrigerator comprising:

an expander which includes a regenerator including a regenerative material and an expansion space for expanding a refrigerant gas flowing in the regenerator; and a temperature rising member which selectively raises a temperature profile at a predetermined temperature range in the regenerator, wherein the regenerative material includes one or more materials selected from a group including lead, bismuth, tin, silver and antimony.

10. A regenerative refrigerator comprising:

an expander which includes a regenerator including a regenerative material and an expansion space for expanding a refrigerant gas flowing in the regenerator; and a temperature rising member which selectively raises a temperature profile at a predetermined temperature range in the regenerator, wherein the temperature rising member is a heat transfer member which is provided outside the expander and connecting two positions whose temperatures are different from each other in a heat exchangeable manner.

11. The regenerative refrigerator according to claim 10, wherein a low temperature end and a high temperature end of the heat transfer member are connected to different positions in an axial direction of the expander.

12. The regenerative refrigerator according to claim 10, wherein a low temperature end of the heat transfer member is connected to an outer peripheral of the expander.

13. The regenerative refrigerator according to claim 10, wherein the heat transfer member is provided to increase the temperature profile at the temperature range in which the specific heat capacity of the refrigerant gas becomes a peak in the regenerator.

14. The regenerative refrigerator according to claim 10, wherein the regenerator includes a high temperature side area including a first regenerative material composed of a non-magnetic material and a lower temperature side area including a second regenerative material composed of a magnetic material, and a low temperature end of the heat transfer member is connected to an outer peripheral of the expander at the high temperature side area.

15. A regenerative refrigerator comprising:

an expander which includes a regenerator including a first regenerative material whose specific heat capacity is smaller than that of lead within a range more than or equal to 5K and less than or equal to 20K, and a second regenerative material provided at a lower temperature side than the first regenerative material and composed of a material different from the first regenerative material, and an expansion space for expanding a refrigerant gas flowing in the regenerator, wherein the position of an interface between the first regenerative material and the second regenerative material is configured to be within a range more than or equal to 5K and less than or equal to 20K in the regenerator.

16. The regenerative refrigerator according to claim 15, wherein a separation plate for separating the first regenerative material and the second regenerative material is provided at the interface in the regenerator.

17. The regenerative refrigerator according to claim 15, wherein the position of the interface between the first regenerative material and the second regenerative material is configured to be within a range more than or equal to 5K and less than or equal to 8K in the regenerator.

18. The regenerative refrigerator according to claim 15, wherein the first regenerative material is selected from one or more materials selected from a group including bismuth, tin, silver and antimony.

19. The regenerative refrigerator according to claim 1, wherein the regenerator is configured such that a temperature profile at temperature ranges other than the predetermined temperature range in the regenerator is the same as the reference case.

20. The regenerative refrigerator according to claim 1, wherein the regenerative material is selected from one or more materials selected from a group including bismuth, tin, silver and antimony.

* * * * *